US005456232A

United States Patent [19]

Firey

[11] Patent Number: 5,456,232

[45] Date of Patent: Oct. 10, 1995

[54] GASOLINE ENGINE FUEL INJECTION SYSTEM

[76] Inventor: Joseph C. Firey, P.O. Box 15514, Seattle, Wash. 98115-0514

[21] Appl. No.: 323,021

[22] Filed: Oct. 14, 1994

[51] Int. Cl.[6] ..... F02B 17/00

[52] U.S. Cl. ..... 123/430

[58] Field of Search ..... 123/430, 262, 123/276, 52 M, 418

[56] References Cited

U.S. PATENT DOCUMENTS

| | | | |
|---|---|---|---|
| 4,116,177 | 9/1978 | Whatley, Jr. | 123/430 |
| 4,574,753 | 3/1986 | Von Seggern | 123/262 |
| 4,770,138 | 9/1988 | Onishi | 123/276 |
| 5,140,952 | 8/1992 | Suominen et al. | 123/52 M |
| 5,170,760 | 12/1992 | Yamada et al. | 123/430 |
| 5,211,147 | 5/1993 | Ward | 123/418 |

*Primary Examiner*—Raymond A. Nelli

[57] ABSTRACT

A gasoline engine fuel injection system is described wherein, during each air intake stroke, the ratio of instantaneous fuel flow rate to instantaneous air flow rate can be essentially constant. By use of this injector system optimum low emission air to fuel ratio can be created within all portions of the intake mixture. Stratified intake mixtures can be created by use of a modified form of the injector system. Such stratified mixtures can be utilized, when needed, to suppress violent compression ignition and knock.

22 Claims, 7 Drawing Sheets

GASOLINE ENGINE FUEL INJECTION SYSTEM

SUMMARY OF THE INVENTION

The gasoline engine fuel injector systems of this invention are suitable for use on four stroke cycle internal combustion engines and comprise at least the following elements:

1. A gas pressure cycler which creates a cycle of pressure rise and decrease during each intake stroke;
2. A fuel injector which injects liquid fuel into the engine intake manifold during each intake stroke;
3. A pressure transmitter which transmits pressure from the gas pressure cycling means to the fuel injector means during each intake stroke;

With these, and associated, elements fuel injection can take place into the engine intake manifold only during the intake stroke and throughout the intake stroke.

The cycle of pressure rise and decrease can be proportioned to the instantaneous rate of air flow into the engine intake manifold so that the ratio of instantaneous fuel flow rate to instantaneous air flow rate can be essentially constant throughout each intake stroke. In this way a uniform air fuel mixture can be created.

A fuel flow controller, responsive to air flow rate per intake stroke and air intake pressure and engine speed, can operate on the pressure transmitter or the fuel injector so that the uniform air fuel ratio created during each intake stroke can be maintained essentially constant over a wide range of engine operating conditions. In this way the air fuel mixtures created in the engine intake manifold can be devoid of both over-rich portions and over-lean portions. Undesirable exhaust emissions generated within such over-rich regions and over-lean regions can thus be avoided and this is a principal beneficial object of this invention. The controller can be additionally responsive to exhaust gas composition sensors to provide feedback to more fully reduce selected exhaust emissions.

Stratifier means for creating a stratified air fuel mixture at each engine intake stroke can be added to the pressure transmitter or to the gas pressure cycler. Such stratified mixtures can be used, when needed, to reduce the violence of compression ignition combustion and this is an additional beneficial object of this invention. A stratifier controller, responsive to a combustion violence sensor, can control the stratifier means so that stratified air fuel mixtures are created only when combustion violence exceeds a selected level.

BACKGROUND OF THE INVENTION

1. Field Of The Invention

This invention is in the field of fuel injection systems for internal combustion engines, and particularly fuel injection system for four stroke cycle engines which inject the fuel into the engine intake manifold.

2. Description Of The Prior Art

Within the past several years the gasoline engine carburetor has been largely replaced with intake manifold gasoline injector systems in many engine applications. Most of these prior art gasoline injector systems inject the fuel at constant pressure and control the fuel quantity by controlling the time duration of injection. An electronic controller, responsive to engine intake air flow rate and engine speed sensors, adjusts time duration of fuel injection so as to maintain the desired overall air to fuel ratio created in the intake manifold. The electronic controller can be additionally responsive to engine exhaust gas composition sensors which provide a feedback control to more closely adjust fuel injection duration, and hence overall air to fuel ratio, for minimum emission of undesirable exhaust gas constituents. This capability of using a feedback control from the exhaust is a principal reason why carburetor fuel systems were replaced with fuel injector systems, since it is difficult to properly introduce feedback control into a carburetor system.

A particular benefit of typical carburetor fuel systems is that the instantaneous rate of fuel flow is roughly proportional to the instantaneous rate of air flow. As a result, during each engine intake stroke, regions of excessively lean air to fuel ratio and other regions of excessively rich air to fuel ratio can be largely avoided and a roughly uniform instantaneous air to fuel ratio is created in each intake mixture charge going into each engine cylinder.

Present gasoline injector systems tend to create both excessively rich air fuel mixture regions and excessively lean air fuel mixture regions since the instantaneous rate of fuel flow is not proportioned to the instantaneous rate of air flow into the engine intake manifold. While fuel injection is taking place an over rich region is created, and, after injection ceases an over lean region is created during each engine intake stroke. The over rich region and the over lean region survive compression, in large part, and their subsequent combustion creates undesirable emission components characteristic of both over lean operation and over rich operation even though the overall air fuel ratio is neither over rich nor over lean.

A principal undesirable exhaust emission from over lean mixtures is oxides of nitrogen, whereas from over rich mixtures carbon monoxide and unburned hydrocarbons are among the undesirable exhaust emissions. Between these over lean mixtures and over rich mixtures a rather narrow "window" of mixture ratios exists where net emissions of both types of undesirable exhaust constituents can be minimized. Yet, even when the overall mixture ratio of an engine lies within this narrow "window," excess emissions may occur if this overall mixture is non uniform and stratified, as when present gasoline injector systems are used which create both over lean regions and over rich regions within each air fuel mixture charge going into each engine cylinder.

It would be very beneficial to have available a gasoline fuel injection system, capable of proportioning instantaneous fuel flow rate to instantaneous air flow rate so that a uniform mixture ratio existed, and lying within the minimum net emissions window, for each air fuel mixture charge going into each engine cylinder. Yet further reductions of undesirable exhaust emissions could be achieved in this way.

DEFINITIONS

The devices of this invention are intended to be used with a four stroke cycle internal combustion engine mechanism, comprising various elements as are well known in the prior art of internal combustion engines, of which the following elements connect to or cooperate with the devices of this invention:

A. Pistons operate within cylinders, and are driven from a rotating crankshaft, via a connecting rod, to vary the volume of a variable volume chamber enclosed between the cylinder walls and the piston crown.

B. Intake valves, at least one for each cylinder, connect and disconnect the variable volume chamber to and from an intake air supply manifold.

C. Exhaust valves, at least one for each cylinder, connect and disconnect the variable volume chamber to and from an exhaust gas manifold.

D. These intake and exhaust valves are opened and closed by a valve drive means driven in turn from the engine crankshaft so that each engine cylinder carries out a four stroke cycle which is repeated. This four stroke cycle comprises, in time order: an air intake stroke whenever the piston is moving to increase the volume of the variable volume chamber and the intake valve is open and the exhaust valve is closed; a compression stroke whenever the piston is moving to decrease the volume of the variable volume chamber and both intake and exhaust valves are closed; an expansion stroke whenever the piston is moving to increase the volume of the variable volume chamber and both intake and exhaust valves are closed; an exhaust stroke whenever the piston is moving to decrease the volume of the variable volume chamber and the exhaust valve is open and the intake valve is closed.

E. A fuel supply source supplies fuel to the engine and this fuel is mixed into the intake air in the intake manifold.

F. An ignition means ignites the air fuel mixture at some time during the latter part of the compression stroke or the early part of the expansion stroke, and a combustion process thus intervenes between compression and expansion processes. Electric spark ignition means are commonly used but compression alone can be used to cause compression ignition of the air fuel mixture.

G. In many engine applications a torque control means is used for controlling the torque output via the engine crankshaft averaged during at least one or more of the four stroke cycles. For gasoline fueled internal combustion engines the torque controller is often a throttle valve in the air intake manifold which, by controlling the air density during the intake stroke, controls the mass air flow rate per intake stroke, and thus the air mass quantity available for combustion and thus controls the torque output. An intake air supercharger can be used additionally or alternatively as a means for controlling the air density during the intake stroke. For diesel fueled internal combustion engines, using compression ignition, the torque controller usually functions to control the fuel mass flow rate per intake stroke, and thus the fuel quantity available for combustion.

H. During each intake stroke the instantaneous air mass flow rate varies greatly, being related to the velocity of motion of the piston during intake. Since piston velocity changes from zero at the start and end of the intake stroke to maximum during the middle portion of the intake stroke, instantaneous air mass flow rate correspondingly varies from zero or low at the start and end of the intake stroke to maximum during the middle portion of the intake stroke.

I. The instantaneous fuel mass flow rate is not necessarily related to the piston velocity or the instantaneous air mass flow rate but depends upon the fuel introduction device used. When a carburetor is used to introduce fuel into the air intake manifold it is the instantaneous air flow rate through the carburetor venturi which generates the pressure difference forcing fuel into the intake manifold. As a result a rough correspondence exists between instantaneous air flow rate and instantaneous fuel flow rate when a carburetor is used. When a timed fuel injector is used, at constant fuel nozzle pressure difference, the instantaneous fuel flow rate is essentially constant during injection, the total fuel quantity injected per intake stroke being proportioned to the total air quantity per intake stroke by controlling the duration of fuel injection.

J. The mean value of air fuel ratio during any one engine intake stroke is the mass ratio of the air flow rate per intake stroke to the fuel flow rate per intake stroke. If electric spark ignition is used to initiate the combustion process this mean value of air fuel ratio must be kept within the spark ignition range. Where compression ignition is used to initiate the combustion process this mean value of air fuel ratio can be varied over a wider range than the spark ignition range.

DESCRIPTION OF THE PREFERRED EMBODIMENTS

Figure 1:
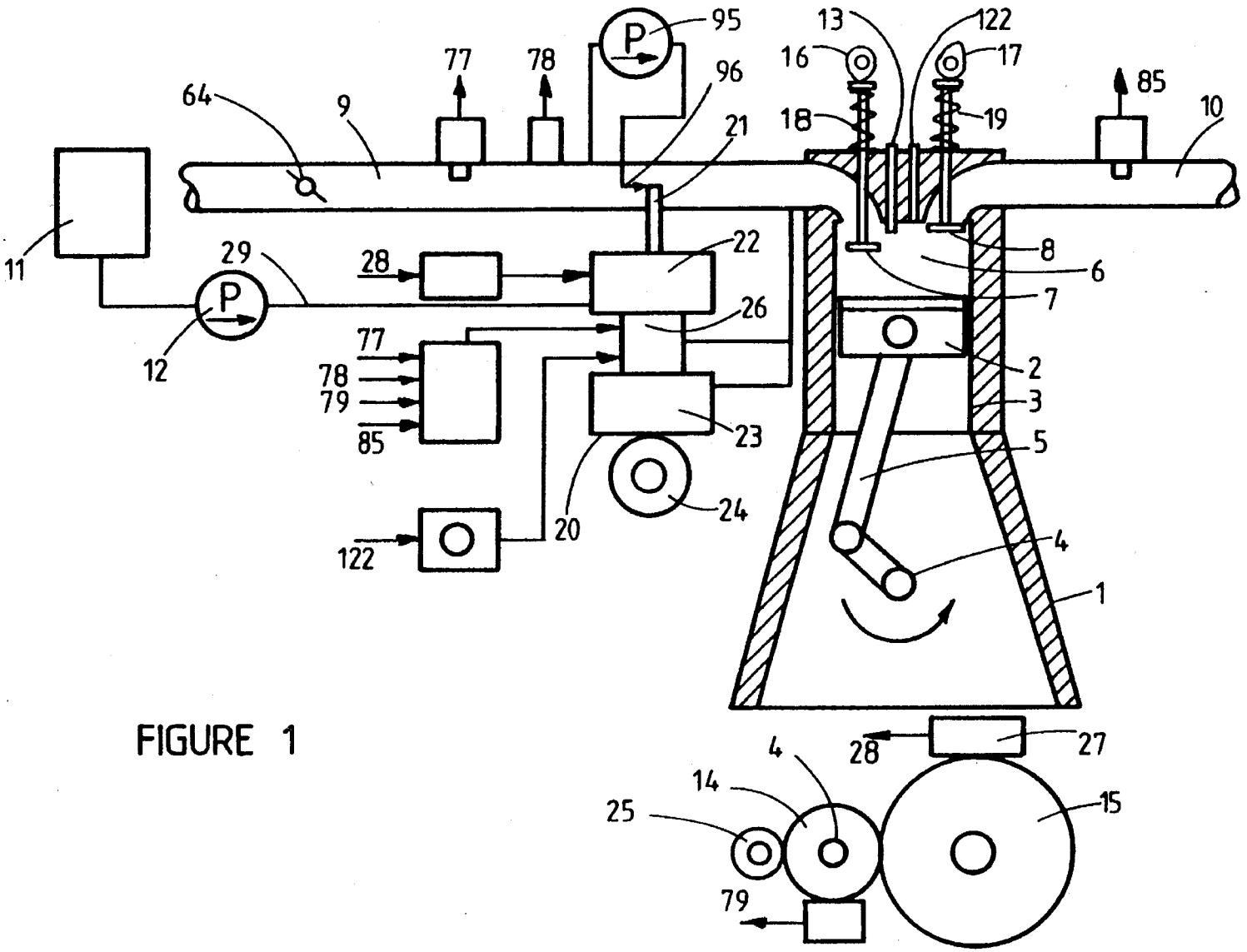
FIG. 1 is a schematic representation of a preferred embodiment of the invention as applied to a four-stroke cycle internal combustion engine.

1. General Description:

The gasoline engine fuel injection systems of this invention are improvements for use in combination with a four stroke cycle internal combustion engine mechanism as described hereinabove. All forms of this fuel injection system comprise the following elements, and each piston and cylinder of the internal combustion engine mechanism is served by one such fuel injection system:

1. A gas pressure cycling means is used for cycling the pressure of a gas quantity within a separate variable volume chamber enclosed between a container and a sealable moving element. The gas pressure cycling means also comprises a pressure cycler means for driving the moving element to alternately decrease the variable volume and thus increase the pressure of the gas quantity and then increase the variable volume and thus decrease the pressure o the gas quantity.

The variable volume chamber of the gas pressure cycling means is preferably connected to the engine air supply manifold during the ending of a pressure decrease and the start of the next pressure increase so that the starting pressure of each cycle of pressure increase and decrease equals the engine intake manifold pressure.

2. An inter drive means for driving the pressure cycler drive means from the engine crankshaft is timed so that a single cycle of pressure increase followed by pressure decrease occurs during each engine intake stroke, and the duration of each cycle of pressure increase and decrease is essentially equal to the duration of the intake stroke.

3. A fuel injector means is used for injecting liquid fuel into the engine air supply manifold during each intake stroke. The fuel injector comprises: a nozzle connecting into the engine air supply manifold; a liquid fuel chamber with a liquid pressurizer means, such as a sealed piston or bellows; a nozzle valve and drive means for connecting and disconnecting the nozzle to the liquid fuel chamber; a fuel supply valve and drive means for connecting and disconnecting the liquid fuel chamber to a source of supply of liquid fuel at pressure at least greater than atmospheric pressure.
4. An intake stroke sensor is used to sense both the start and the end of each intake stroke. This sensor output is input to a fuel valve controller which controls the opening and closing of both the nozzle valve and the fuel supply valve of the fuel injector means so that, the nozzle is connected to the liquid fuel chamber only during and throughout each intake stroke, and the fuel supply source is connected to the liquid fuel chamber only when the nozzle is disconnected from the liquid fuel chamber.
5. A pressure transmitter is used to transmit pressure from the variable volume chamber of the gas pressure cycler to the liquid fuel within the liquid fuel chamber of the fuel injector only during and throughout each intake stroke. This pressure transmitter can be for example a simple sealed piston connected directly to the liquid pressurizer of the fuel injector and acted upon by the gas pressure in the variable volume chamber of the gas pressure cycler during each intake stroke. To avoid pressure transmission to the liquid fuel chamber during all engine strokes other than the intake stroke, various means can be used, such as a valve to vent the variable volume chamber of the gas pressure cycler only during these other strokes.

With the above minimum number of elements, and these connected as described, the fuel injection system of this invention operates as follows:

1. During and throughout each engine intake stroke pressure is created in the variable volume chamber of the gas pressure cycler whose moving element is being driven by the pressure cycler drive means and the inter drive means from the engine crankshaft.
2. This pressure created in the variable volume chamber of the gas pressure cycler acts via the pressure transmitter to create a pressure on the liquid fuel in the liquid fuel chamber of the fuel injector during and throughout each engine intake stroke.
3. The fuel injector nozzle valve being opened during and throughout each intake stroke by action of the fuel valve controller, liquid fuel is injected into the intake manifold via the fuel injector nozzle under the effect of the pressure created in the liquid fuel chamber. Such injection of liquid fuel into the engine intake manifold occurs only during and throughout the intake stroke since the nozzle valve is closed during all other engine strokes.
4. While the fuel injector nozzle valve of the fuel injector is closed during all engine strokes other than the intake stroke the fuel supply valve is opened by action of the fuel valve controller so that liquid fuel from the supply source can be forced by supply pressure into the liquid fuel chamber of the fuel injector to replace that fuel injected into the engine intake manifold during the preceding intake stroke. No pressure is transmitted to the liquid fuel chamber during all engine strokes other than the intake stroke so that such refueling of the liquid fuel chamber can occur and so that the liquid pressurizer means of the fuel injector and the pressure transmitter can be returned to starting positions.
5. The fuel supply valve of the fuel injector is closed by action of the fuel valve controller so that fuel does not backflow into the supply source during the intake stroke when the liquid fuel chamber is under the pressure created by the gas pressure cycler acting via the pressure transmitter.

In this way the liquid fuel is injected into the engine intake manifold during and throughout each intake stroke at the same time that intake air is also flowing into the engine cylinder during and throughout the intake stroke. During each intake stroke the instantaneous mass rate of flow of air through the intake manifold and into the engine cylinder is approximately proportional to the instantaneous piston speed, which varies roughly sinusoidally from zero at piston top and bottom dead centers to a maximum near piston mid travel. Also during each intake stroke the instantaneous mass rate of flow of liquid fuel through the fuel injector nozzle and into the intake manifold and thence, in company with the intake air flow, into the engine cylinder is approximately proportional to the square root of the net pressure difference between the liquid fuel chamber and the intake manifold. This net pressure difference is created by action of the gas pressure cycler and the pressure transmitter, and varies during the intake stroke. The instantaneous mass ratio of air to fuel of the air fuel mixtures thusly created in the engine intake manifold can be varied during the intake stroke by varying the pressure transmitted into the liquid fuel chamber from the gas pressure cycler. Hence many different regions of air fuel mixture can be created within each total charge of air and fuel going into the engine cylinder during each intake stroke by suitable variation of the pressure in the liquid fuel chamber relative to the instantaneous mass rate of flow of air.

In many engine uses it will be preferred that all regions of air fuel mixture be nearly alike in air fuel ratio in order to avoid both over rich regions and over lean regions and thus to avoid the undesirable exhaust emissions generated during the combustion of such regions. The constant mixture ratio cam drive means for driving the moving element of the gas pressure cycler described hereinbelow is one example scheme for achieving uniformity of air fuel ratio in all mixture regions of each total charge of air and fuel going into the engine cylinder during each intake stroke. This constant mixture ratio cam drive means is one of the preferred drive means for driving the moving element of the gas pressure cycler because of this beneficial minimizing of engine exhaust emissions thus made possible.

In other engine uses it may be preferred that a stratified mixture be created in the engine intake wherein different regions possess different air fuel ratios. Such stratified intake air fuel mixtures can be used to suppress the violence of compression ignition combustion by methods described in U.S. Pat. Nos. 4,147,137 and 4,425,892 and this material is incorporated herein by reference thereto. The devices of this invention can be used to create such stratified intake air fuel mixtures in several ways. For example, such a stratified intake mixture can be generated by driving the moving element of the gas pressure cycler relative to the engine crankshaft so that the ratio of the instantaneous fuel mass flow rate into the intake manifold to the instantaneous air mass flow rate into the intake manifold varies about a mean valve during each intake stroke. If the moving element of the gas pressure cycler is a piston operative within a cylinder, and this piston is driven by a conventional crank and connecting rod drive means from a shaft whose speed is twice the engine crankshaft speed, a stratified mixture will be generated principally because the instantaneous mass rate of fuel flow varies non linearly with the pressure in the liquid fuel chamber. This crank and connecting rod drive for the moving element of the gas pressure cycler is one example of a stratifier means. Other stratifier means will be described hereinbelow.

One example arrangement of the devices of this invention on a four stroke cycle internal combustion engine mechanism is shown schematically in FIG. 1 and comprises the following:

1. A four stroke cycle, single cylinder, engine, 1, is shown with piston, 2, cylinder, 3, crankshaft, 4, connecting rod, 5, variable volume chamber, 6, air intake valve, 7, exhaust valve, 8, air supply manifold, 9, exhaust gas manifold, 10, fuel supply source, 11, and fuel supply pressure pump, 12, ignition means, 13.
2. The valve drive means is shown separated from the engine for clarity and comprises: a drive gear, 14, connected to the crankshaft, 4, and rotated at crankshaft speed, a valve drive gear, 15, rotated at half crankshaft speed by the drive gear, 14, and driving in turn the intake valve cam, 16, and the exhaust valve cam, 17.The intake and exhaust valves are opened by these cams and closed by springs, 18, 19, in FIG. 1 the intake valve is shown open and the exhaust valve is shown closed with the piston descending on the intake stroke and increasing the volume of the variable volume chamber, 6, and intake air is flowing through the intake manifold, 9, and into the variable volume chamber, 6.
3. A gasoline engine fuel injection system, 20, of this invention is shown in FIG. 1 and comprises:
   a. A fuel injector nozzle, 21, is injecting liquid fuel into the intake manifold, 9, whenever intake air if flowing into the engine cylinder. This liquid fuel flows from the liquid fuel chamber of the fuel injector means, 22.
   b. A gas pressure cycling means, 23, is driven by a pressure cycler drive means, 24, which is in turn driven at twice crankshaft speed from the inter drive means, 25, driven in turn from the crankshaft drive gear, 14.
   c. A pressure transmitter means, 26, transmits pressure from the gas pressure cycler, 23, to the liquid fuel chamber of the fuel injector, 22.
   d. An intake stroke sensor, 27, is one input to a fuel valve controller means, 28, which controls the opening and closing of a nozzle valve and a fuel supply valve within the fuel injector means, 22, so that: the fuel injector nozzle, 21, is connected to the liquid fuel chamber of the fuel injector, 22, only whenever air is flowing into the variable volume chamber, 6, during the intake stroke; the engine fuel supply source is connected via pipe, 29, to the liquid fuel chamber of the fuel injector, 22, only when the nozzle valve is closed.

Figure 2:
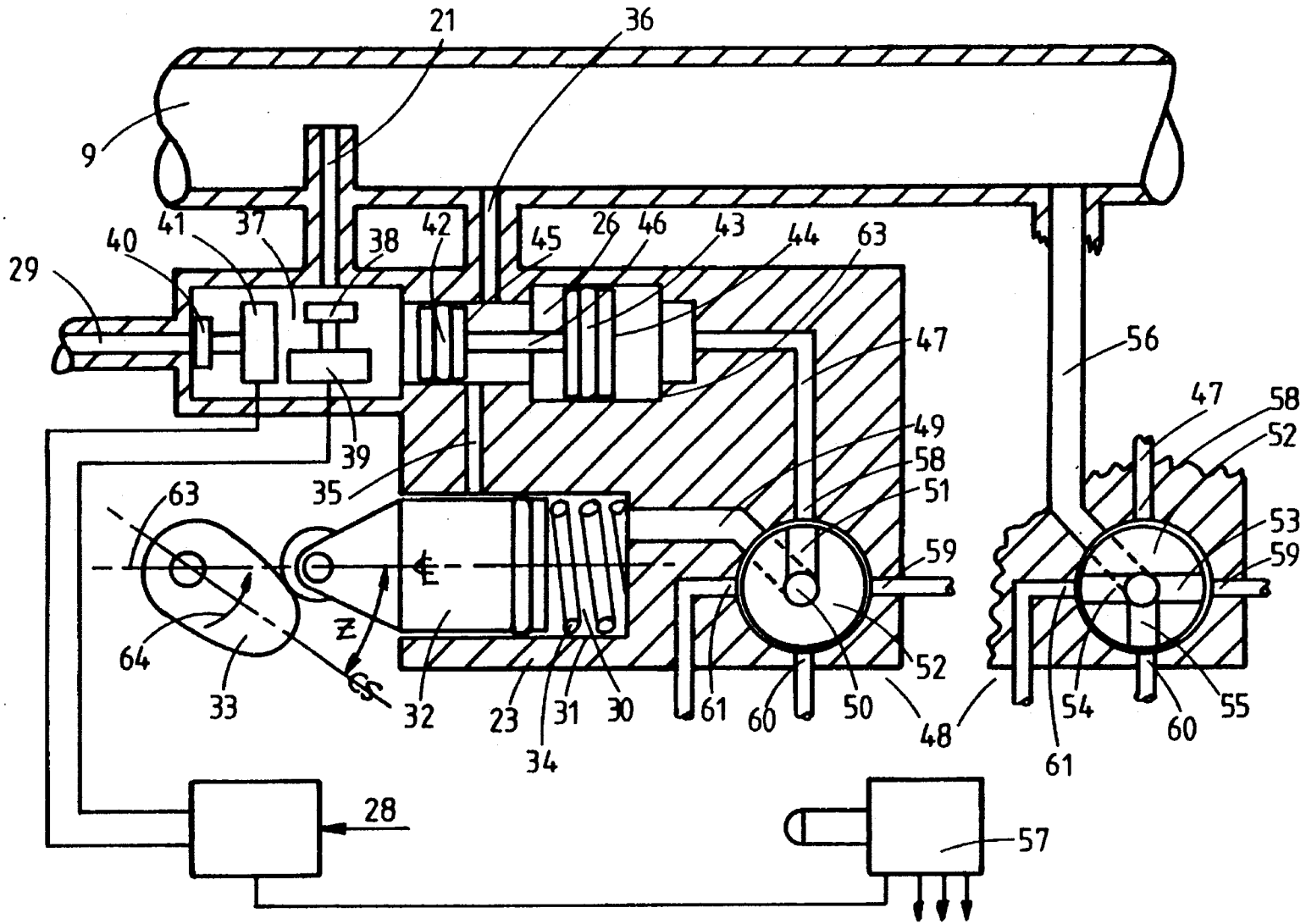
FIG. 2 is a cross-sectional view of a first preferred embodiment of the invention.

A particular example fuel injection system, 20, of this invention is shown in detail in cross section in FIG. 2 and FIG. 1 and comprises the following:

4. The gas pressure cycler, 23, comprises a variable volume chamber, 30, enclosed between the fixed cylinder container, 31, and the moveable sealed piston, 32, which is driven by the pressure cycler drive means cam, 33, and spring, 34, driven in turn from the inter drive means, 25. When the piston, 32, is moved by the cam, 33, to decrease the volume of the variable volume chamber, 30, the gas pressure therein rises, and when the piston, 32, is moved by the spring, 34, and the cam, 33, to increase the volume of the variable volume chamber, 30, the gas pressure therein decreases. In this way a cycle of pressure increase followed by pressure decrease is created at each revolution of the pressure cycler drive cam, 33, and this cycle is timed by the inter drive means, 25, to occur during and throughout each engine intake stroke. The pressure in the variable volume chamber, 30, at the start of each pressure cycle is equalized to that in the engine air intake manifold, 9, via the vent connections, 35, and 36.
5. The fuel injector means for injecting liquid fuel, 22, into the engine intake manifold, 9, comprises a liquid fuel chamber, 37, connectable and disconnectable to the fuel injector nozzle, 21, via the nozzle valve, 38, with nozzle valve drive means, 39, and connectable and disconnectable to the fuel supply source pipe, 29, via the fuel supply valve, 40, with supply valve drive means, 41. The fuel injector nozzle, 21, connects into the engine air intake manifold, 9. A liquid fuel sealed pressurizer piston, 42, applies force from the pressure transmitter, 26, to the liquid fuel within the liquid fuel chamber, 37, and has engine air intake manifold pressure acting on its opposite side, 45, via the vent connection, 36.
6. The pressure transmitter, 26, comprises a sealed gas piston, 43, acted on one side, 44, by the gas quantity in the variable volume chamber, 30, of the gas pressure cycler, 23, and acted on the other side by the pressure in the engine air intake manifold, 9, via the vent connection, 36. The sealed gas piston, 43, is connected directly to the liquid fuel pressurizer piston, 42, by the transmitter bar, 46, in this FIG. 2 form of the invention, so that, the force acting on the gas piston, 43, which is essentially proportional to the net pressure difference between the variable volume chamber, 30, and the air intake manifold, 9, acts also on the liquid fuel pressurizer piston, 42, to create a pressure in the liquid fuel chamber, 37, also essentially proportional to the net pressure difference between the variable volume chamber, 30, and the air intake manifold, 9. The side, 44, of the gas piston, 43, connects to the variable volume chamber, 30, via the pipe, 47, and the selector valve, 48, and the pipe, 49, wherein the pipe, 49, from the variable volume chamber, 30, connects to the common pressure inlet, 50, of the selector valve, 48, and the selector valve pressure port, 51, is shown in FIG. 2 as connecting to the pipe, 47.
7. The fuel valve controller, 28, receives an input signal from the intake stroke sensor, 27, and operates to open and close the nozzle valve, 38, and the fuel supply valve, 40, via their respective drive means, 39 and, 41, so that the nozzle valve, 38, is open only during and throughout the intake stroke, and so that the fuel supply valve, 40, is open only when the nozzle valve, 38, is closed. An electronic controller, 38, and solenoid or solenoid and spring drive means, 39, and, 41, are shown in this FIG. 2 form of the invention. But a wholly or partially mechanical drive means and controller can alternatively be used with the nozzle valve and fuel supply valve opened and closed by mechanical drive means, driven in turn via a control drive from the engine crankshaft or camshaft, since the timing of these valves is essentially fixed relative to the engine piston and crankshaft motion.

8. A selector valve, 48, is shown in the FIG. 2 form of this invention, which is suitable for use with four cylinder internal combustion engines, and which comprises:
   a. A rotatable valve port element, 52, with a pressure port, 51, and three interconnected vent ports, 53, 54, 55, has a common pressure inlet, 50, connecting only to the pressure port, 51, and the pressure pipe, 49, from the variable volume chamber, 30, of the gas pressure cycler, 23. The rotatable valve port element, 52, also has a common vent inlet connecting only to the vent ports, 53, 54, 55, and the vent pipe 56, to the engine air intake manifold.
   b. A selector valve drive, 57, is shown separated from the rotatable port element, 52, for clarity, and comprises a solenoid, spring, and ratchet type drive mechanism which rotates the rotatable port element, 52, through a 90 degree angle, each time a start of intake stroke signal is received from the fuel valve controller, 28.
   c. Four fixed ports, 58, 59, 60, 61, connect separately to each separate pressure transmitter of each separate engine cylinder, the fixed port, 58, connecting to the pressure transmitter, 26, of that one engine cylinder whose air intake manifold, 9, is shown in FIG. 2. The pressure port, 51, of the rotatable port element, 52, is shown in FIG. 2 indexed to the fixed port, 58, for the pressure transmitter, 26, and will remain thusly indexed during and throughout the intake stroke of that engine cylinder whose air intake manifold is, 9. In this way the pressure in the variable volume chamber, 30, is transmitted via pipe, 49, selector valve, 48, pressure port, 51, fixed port, 58, pipe, 47, to the side, 44, of the gas piston, 43, of the pressure transmitter, 26.
   d. The selector valve drive means, 57, indexes the pressure port, 51, of the rotatable port element, 52, to the fixed port, 58, at the start of the intake stroke of the thusly connected engine cylinder of air intake manifold, 9, upon receipt of the start of intake stroke signal from the fuel valve controller, 28, of this connected engine cylinder, and this indexing of port, 51, to port, 58, is retained until the selector valve drive means, 57, receives a start of intake stroke signal from that other engine cylinder next in firing order. The fixed ports are arranged in the engine firing order for the four cylinders being served by the single gas pressure cycler, 23.
   e. When the pressure port, 51, is thusly connected to the fixed port, 58, the remaining fixed ports, 59, 60, 61, are indexed by the vent ports, 53, 54, 55, and the pressure transmitters for these three other cylinders are then vented to an air intake manifold, so that no pressure is transmitted from the gas pressure cycler, 23, to these other pressure transmitters during the intake stroke for that engine cylinder undergoing an air intake process. This arrangement of pressure and vent ports is repeated in turn in the engine cylinder firing order for each of the four engine cylinders.
   f. Electronic and electric drive means, 57, and control means, 28, for the selector valve, 48, are shown in the FIG. 2 form of this invention but wholly or partially mechanical drive and control means can alternatively be used since the timing of the selector valve is essentially fixed relative to the engine piston and crankshaft motion.

9. When a fuel injection system of this invention is to be used on a single cylinder engine, the selector valve shown in FIG. 2 can be replaced with a simple pressure and vent valve which opens to vent the pressure transmitter gas pressure side during the engine compression, expansion and exhaust strokes, and closes to transmit pressure from the gas pressure cycler to the gas pressure side of the pressure transmitter only during and throughout the engine air intake stroke.

The example fuel injection system of this invention shown in FIG. 2 and FIG. 1 operates as follows:

10. At the start of the intake stoke of the engine cylinder of air intake manifold, 9, the fuel valve controller, 28, having closed the fuel supply valve, 40, opens the nozzle valve, 38, and indexes the gas pressure cycler, 23, to the pressure transmitter, 26, via ports, 51, and 58.

11. At the start of the intake stroke the pressure cycler drive cam, 33, centerline of symmetry, CS, is at an angle, Z, of 180 degrees to the moveable piston centerline, 63, and is being rotated in the direction, 64, by the inter drive means, 25. Thus the variable volume, 30, starts at its maximum value.

12. During an intake stroke the pressure cycler drive cam, 33, will be rotated in the direction, 64, one full turn of 360 degrees during one full intake stroke of 180 degrees, crankshaft rotation. The pressure cycler drive cam, 33, and return spring, 34, thus moves the piston, 32, to first decrease the volume of the variable volume chamber, 30, and then to increase the volume of the variable volume chamber, 30, during each intake stroke. In this way a pressure cycle of pressure increase followed by pressure decrease is created in the variable volume chamber and this cycle of pressure is applied via the pressure transmitter, 26, to the liquid fuel in the liquid fuel chamber, 37.

13. The nozzle valve, 38, being open during and throughout the intake stroke, liquid fuel is forced by the pressure thusly created in the liquid fuel chamber, 37, through the fuel injector nozzle, 21, and into the air mass then flowing through the intake manifold, 9, and into the engine cylinder. The instantaneous mass rate of flow of liquid fuel into the engine air intake manifold 9, during the intake stroke is approximately proportional to the square root of the pressure difference between the liquid fuel chamber, 37, and the air intake manifold, 9, and is approximately inversely proportional to the flow resistance of the fuel injector nozzle. The flow resistance of the fuel injector nozzle is approximately inversely proportional to the flow area thereof.

14. The air fuel ratio of the air fuel mixture being created in the intake manifold, 9, will be the ratio of the instantaneous mass rate of flow of air to the instantaneous mass rate of flow of fuel. The instantaneous mass rate of flow of air is roughly proportional to the instantaneous engine piston speed. An essentially constant air fuel ratio can be achieved in the air fuel mixture by designing the pressure cycler drive cam, 33, so that the resulting instantaneous mass rate of flow of fuel is proportional to the instantaneous mass rate of flow of air throughout the intake stroke. This particular profile of the pressure cycler drive cam is herein referred to as a constant mixture ratio cam profile and this cam profile will be preferred in many engine applications. Other cam profiles can be used, and other types of pressure cycler drive means can be used, such as the crank and connecting rod type of drive means, and these alternative drive means will create non uniform air fuel mixtures in the engine intake manifold. Details of the constant mixture ratio cam profile will be described hereinbelow.

15. At the end of the intake stroke the fuel valve controller, 28, closes the nozzle valve, 38, and indexes the pressure transmitter, 26, to the vent, 56, and indexes the gas pressure cycler, 23, to the pressure transmitter for that engine cylinder next in the firing order. The fuel supply valve, 40, is then opened and the fuel supply pressure replaces that liquid fuel just previously injected by pushing the pressure transmitter pistons, 42, and 43, back against the stop, 63.

16. The pressure cycler drive cam, 33, continues to rotate but the gas pressure cycler is now similarly acting on the pressure transmitter and liquid fuel injector of the engine cylinder next in the firing order.

CONSTANT MIXTURE RATIO DRIVE

The cam profile for the constant mixture ratio pressure cycler drive cam is best determined experimentally but an approximate cam profile can be calculated using the following equations for a symmetrical cam:

$$(gcm) = \frac{1}{[CRC-1]}\left[\frac{CRC}{\left\{1+\left[\frac{(CRC)^n-1}{2}\right](1-\text{Cosy})\right\}^{\frac{1}{n}}}-1\right]$$

Wherein:

(CRC)-Gas pressure cycler compression ratio;

$$(CRC)=\frac{(VDC+VCLP)}{(VCLP)}=\left[\frac{\text{maximum } pa}{po}\right]^{\frac{1}{n}}$$

(VDC)=Displacement volume of the gas pressure cycler, and (VDC)+VCLO) is the maximum volume of the variable volume thereof;

(VCLO)=Clearance volume of the gas pressure cycler and the minimum volume of the variable volume thereof;

n=Polytropic exponent for the gas compression and expansion processes in the gas pressure cycler variable volume;

(Maximum pa)=Maximum design pressure to be created in the variable volume chamber of the gas pressure cycler;

(po)=Starting pressure in the variable volume chamber of the gas pressure cycler at y=0 degrees, essentially equal to the pressure in the engine air intake manifold at the point where liquid fuel is injected;

(VDC)=(ra1-ra0) (AGP)

(AGP)=Gas pressurizer piston area;

$$\left(\frac{\text{Maximum } pa}{po}\right)=(CRC)^n=1+$$

-continued $$\left[\frac{(WA)(3.1417)(RPM)}{(Al)(\sqrt{2g(df)})(\sqrt{po})(\sqrt{J})(A/F)_c}\right]^2$$

(WA)=Engine intake air mass flow rate per intake stroke.

(RPM)=Engine crankshaft speed.

(Al)=Flow area of liquid fuel orifice.

(df)=Liquid fuel density.

g=Gravitational constant;

$$J=\text{Pressure transmitter transmission ratio}=\left(\frac{Pf-po}{pa-po}\right)$$

$$J=\left(\frac{Aa}{Af}\right)$$ For the particular case where liquid pistion and gas piston are directly connected as shown in FIG. 2

(pf)=Pressure in liquid fuel chamber;

(pa)=Pressure in variable volume chamber of gas pressure cycler;

(Aa)=Area of gas piston;

(Af)=Area of liquid piston;

$$\left(\frac{A}{F}\right)_c=\text{Desired value of constant instantaneous mass ratio of air to fuel in the engine intake manifold;}$$

Figure 3:
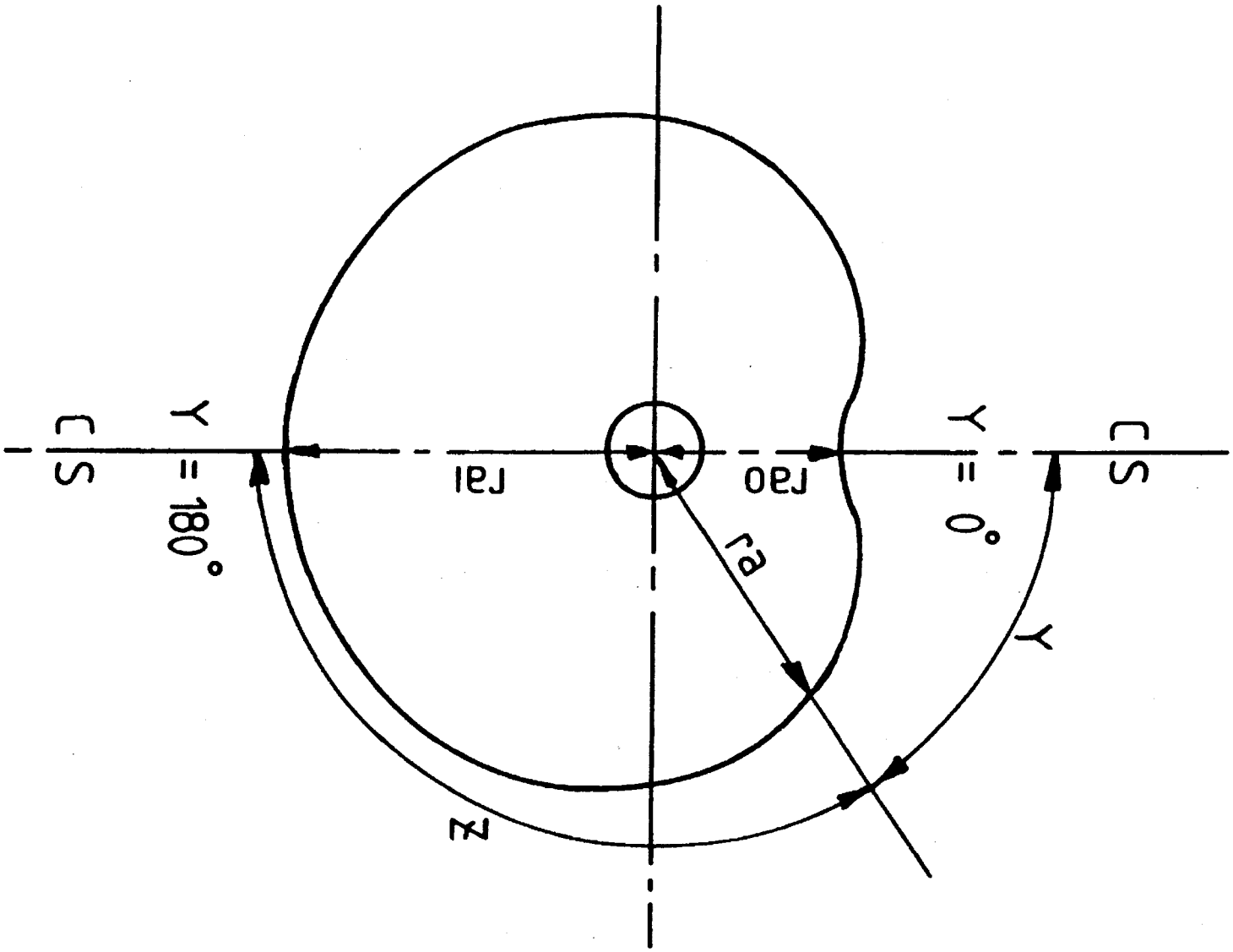
FIG. 3 is a diagram of a constant-mixture ratio cam.

Y=angle from the cam centerline of symmetry, CS, to the angular position where the cam radius is equal to ra. Refer to FIG. 3, ra0=Minimum value of cam radius at centerline of symmetry, CS, where Y=0 degrees;

ra1=Maximum value of cam radius at centerline of symmetry, CS, where Y=180 degrees;

X=Engine crankshaft angle measured from the piston top dead center position where X=0 degrees;

Any consistent system of units can be used in the foregoing equation.

The pressure cycler drive cam is driven by the inter drive means at twice crankshaft speed, and with the theoretical phase relation that Y=0 degrees when X=degrees and also when X=180 degrees.

These equations are based on the following assumptions which are approximations:

1. The instantaneous mass rate of flow of air through the engine air intake manifold, 9, can be approximated as proportional to instantaneous engine piston velocity when the effects of the ratio of connecting rod length to crank radius are neglected;
2. The instantaneous mass rate of flow of liquid fuel through the nozzle of the fuel injector is proportional to the square root of the net liquid pressure difference between that in the liquid fuel chamber of the fuel injector and that in the engine air intake manifold;
3. The starting, or minimum, pressure in the gas pressure cycler, when Y=0, is equal to the pressure in the air intake manifold at the point where liquid fuel is injected into the manifold;
4. The pressure transmitter maintains an essentially constant ratio between, the net liquid pressure difference between the liquid fuel chamber and the engine air intake manifold, and the net gas pressure difference between the gas pressure in the variable volume chamber of the gas pressure cycler and the pressure in the engine air intake manifold during any one engine intake stroke;

5. More accurate assumptions can be made to create more accurate equations for the constant mixture cam profile. However, best uniformity of the air fuel mixture created during each intake stroke can be achieved by using an approximate cam profile and then experimentally measuring both the instantaneous mass rate of air flow and the instantaneous mass rate of liquid fuel flow. Corrections can then be made to the cam profile and to the phase relation between the cam and the engine crankshaft to achieve the desired degree of air fuel mixture uniformity.

By use of the fuel injection system of this invention, with a constant mixture ratio cam for driving the gas pressure cycler, the net fuel air mixture going into each engine cylinder during each intake stroke can be uniform and devoid of both over lean regions and over rich regions. In this way undesirable exhaust emissions of both oxides of nitrogen and carbon monoxide can be minimized and this is one of the beneficial objects of this invention.

So that the liquid fuel displacement out of the liquid fuel chamber during fuel injection during each engine intake stroke will not appreciably affect the gas pressures developed in the variable volume of the gas pressure cycler, the ratio of gas pressure cycler piston displacement (VDC) to engine piston displacement per cylinder (VD), is preferably determined by the following approximate equation:

$$\left(\frac{VDC}{VD}\right)=\frac{(Wa)}{(VD)}\left(\frac{Z}{(A/F)}\right)\frac{1}{(df)}$$

Wherein the factor Z had a preferred numerical value of at least 10 and not more than 500.

COMPENSATION FOR ENGINE SPEED AND TORQUE CHANGES

The simple form of this invention shown in FIG. 2 and described hereinabove is suitable for use on internal combustion engines operated at steady torque and speed, as for example in some kinds of water pumping or electric power generating use. But many internal combustion engines are operated at widely varying torque and speed, as for example in automobiles and trucks. Engine torque output is commonly varied by varying the density of the air entering the engine air intake manifold, 9, as by use of a throttle, 64, and by use of an intake air supercharger, in order to vary the mass rate of air flow per intake stroke. But the mass rate of liquid fuel flow per intake stroke is not correspondingly varied when intake air density is thusly varied for the FIG. 2 form of this invention. Thus the mean value of air fuel ratio for each intake stroke, which is the ratio of mass rate of air flow per intake stroke to mass rate of flow of fuel per intake stroke, will become fuel leaner as intake air density is increased and will become fuel richer as intake air density is decreased with this FIG. 2 form of the invention.

At a particular intake air density the mass rate of air flow per intake stroke will remain roughly constant over a rather wide range of engine speeds. But the mass rate of flow of liquid fuel per intake stroke decreases as engine speed increases, for the FIG. 2 form of this invention, since the time rate of instantaneous liquid fuel flow is essentially constant and the time duration of the intake stroke and hence the time duration for liquid fuel flow decreases as speed increases. Thus the mean value of air fuel ratio for each intake stroke will become leaner as engine speed increases and will become richer as engine speed decreases with this FIG. 2 form of the invention.

Modified pressure transmitter means or modified fuel injector means can be used to achieve essentially constant values of mean air fuel ratio per intake stroke with widely varying engine torque and speed as described hereinbelow.

PIVOTED LEVER PRESSURE TRANSMITTER COMPENSATOR

Figure 4:
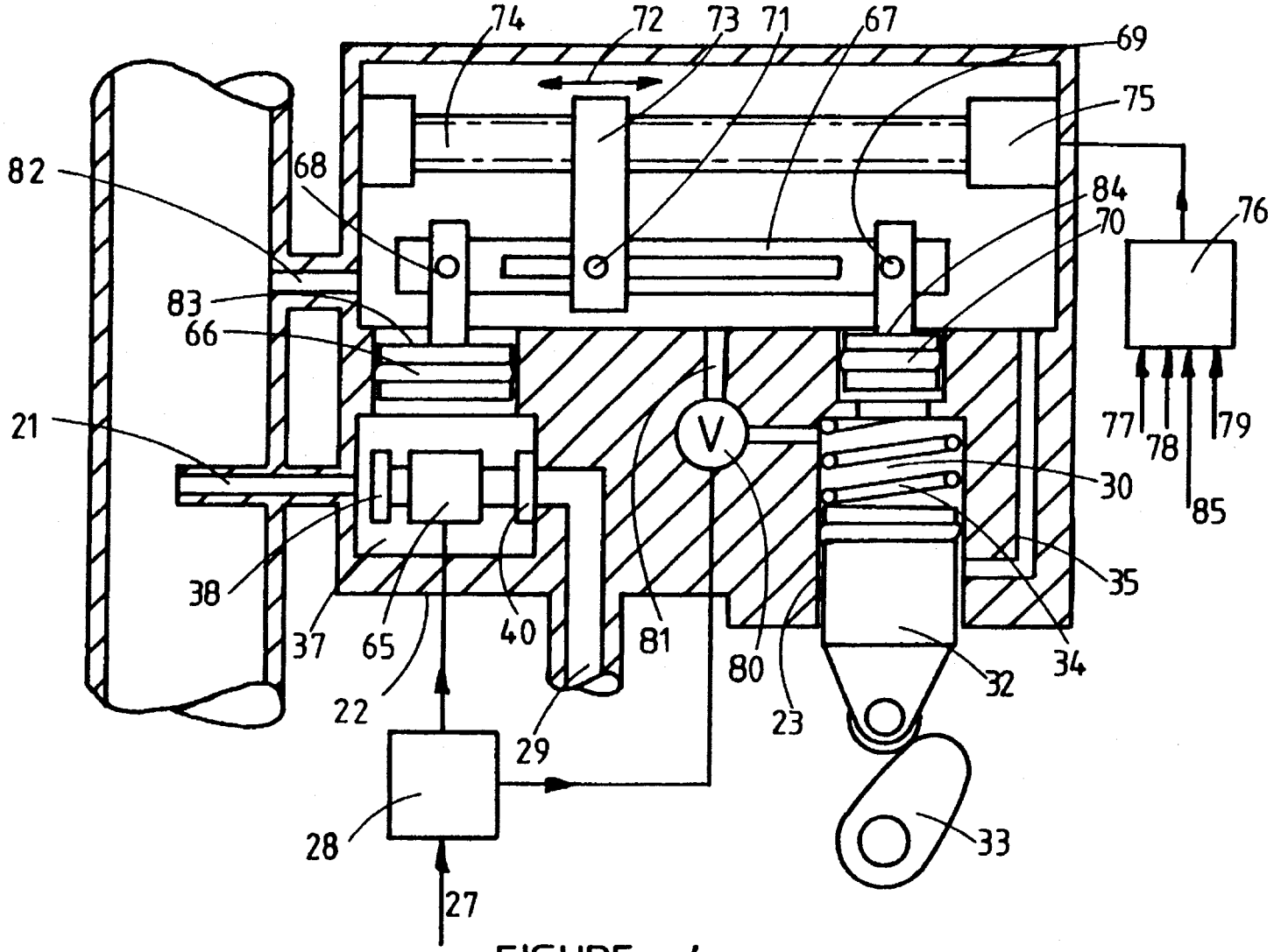
FIG. 4 is a cross section of a second preferred embodiment of the invention as applied to a four-stroke cycle internal combustion engine.

A particular example modified form of pressure transmitter is shown in cross section in FIG. 4 and FIG. 1, suitable for use on internal combustion engines operated over a wide range of speed and torque output, and comprises:

1. The gas pressure cycler, 23, comprising; variable volume chamber, 30, piston, 32, pressure cycler drive cam, 33 and return spring, 34, vent connection, 35, is similar to that of FIG. 2 and operates similarly as described hereinabove.
2. The fuel injector 22, comprising liquid fuel chamber, 37, injector nozzle, 21, nozzle valve, 38, fuel supply valve, 40, is also similar to that of FIG. 2 and operates similarly as described hereinabove. A combined drive means, 65, for driving both the nozzle valve, 38, and the fuel supply valve, 40, is shown in FIG. 4 and can be a single solenoid driver which opens the nozzle valve when closing the fuel supply valve and vice versa.
3. The liquid fuel pressurizer liquid piston, 66, is connected to the end, 68, of a pivoted lever, 67, whose opposite end, 69, is connected to the pressure transmitter gas piston, 70, so that pressure created in the variable volume chamber, 30, of the gas pressure cycler, 23, is transmitted to the liquid fuel in the liquid fuel chamber, 37. The pivoted lever, 67, is pivoted about the pivot, 71, so that the force transmitted from the pressure transmitter piston, 70, to the liquid fuel pressurizer piston, 66, can be adjusted by moving the pivot, 71, in the directions, 72, relative to the ends, 69, and 68, of the lever, 67, where the gas piston, 70, and the liquid piston, 66, respectively connect to the lever, 67. When the pivot, 71, is moved toward the liquid piston, 66, the net force transmitted to the liquid fuel in the liquid fuel chamber, 37, is increased relative to the net force acting on the gas piston, 70, the reverse effect occurring when the pivot, 71, is moved toward the gas piston, 70.

In this way the ratio of net liquid pressure on the liquid fuel in the liquid fuel chamber, 37, to the net gas pressure on the gas piston, 70, can be adjusted by varying the position of the pivot, 71, relative to the liquid piston, 66, and the gas piston, 70. Also in this way the instantaneous mass rates of flow of liquid fuel can be increased by moving the pivot toward the liquid piston, 66, and away from the gas piston, 70, and vice versa. When the instantaneous mass rates of flow of liquid fuel are thusly increased or decreased the mass rate of fuel flow per intake stroke is also correspondingly increased or decreased and thus the mean value of air fuel ratio for each intake stroke can be adjusted by adjusting the position of the pivot, 71, relative to the liquid piston 66, and the gas piston, 70.

4. An example pivot adjustment means for moving the pivot, 71, of the lever, 67, is shown in FIG. 4 and comprises; a threaded pivot holder, 73, fitted to the adjustment screw, 74, which can be rotated by the pivot drive means, 75, so that the pivot, 71, can be moved in the directions, 72, but does not move at right angles to this direction. A rotary pivot drive means, 75, is shown in this FIG. 4 example, such as an electric motor or electric stepping motor, but other pivot drive means, such as hydraulic or pneumatic drive means can alternatively be used as is well known in the art of controllers.

5. An example electronic fuel flow control means, 76, is shown in FIG. 4, which is responsive to; an engine intake air mass flow rate per intake stroke sensor, 77, an intake manifold pressure sensor, 78, and an engine speed sensor, 79, and operates upon the pivot drive means, 75, to adjust the position of the pivot, 79 , relative to the gas piston, 70, and the liquid piston, 66. The control means, 76, operates via the pivot drive means, 75, so that the pivot, 71, is moved closer to the liquid piston when intake air mass flow rate per intake stroke increases, or when engine speed increases, or when intake manifold pressure decreases, and moves the pivot oppositely when these quantities change oppositely.

For an essentially constant mean value of air fuel ratio over a range of engine speeds and torque outputs the proper relation between pivot position and intake air mass flow rate per intake stroke, engine speed, and intake manifold pressure is best determined experimentally.

The following approximate equation for the FIG. 4 form of this invention can be used when a constant mixture cam is used in the gas pressure cycler drive means:

$$\frac{(RPM)(Wa)}{\sqrt{po}}\ \frac{1}{\sqrt{J}} = \text{a constant} = (PS) =$$

$$\left(\frac{A}{F}\right)_c \frac{(Al)(\sqrt{2g(df)})(\sqrt{(CRC)^n} - 1)}{(3.1417)}$$

$$J = \left(\frac{pf - po}{pa - po}\right)$$

For the pivoted lever pressure transmitter:

$$J = \frac{(Aa)(la)}{(Af)(lf)}$$

And the value of J is adjusted by the pivot controller so that the value of (PS) remains essentially constant.

Wherein:

(lf)=Distance from pivot, 71, to the end, 68, where the liquid piston, 66, connects to the lever, 67;

(la)=Distance from pivot, 71, to the end, 69, where the gas piston, 70, connects to the lever, 67;

Any consistent system of units can be used in the foregoing equations. An electronic fuel flow control means, 76, using particular sensors, 77, 78, 79, as input, is shown for this FIG. 4 form of the invention but other sensors and other control means can alternatively be used such as wholly mechanical sensors and controllers or combination electronic and mechanical controllers and sensors as is well known in the art of sensors and controllers.

6. The fuel valve controller, 28, receives an input signal from the intake stroke sensor, 27, and operates to open and close the nozzle valve, 38, and the fuel supply valve, 40, via their combined drive means, 65, so that the nozzle valve, 38, is open only during and throughout the intake stroke, and so that the fuel supply valve, 40, is open when the nozzle valve is closed. The fuel valve controller, 28, also operates to close the pressure and vent valve, 80, only during and throughout the engine intake stroke, so that pressure rise is developed in the variable volume chamber, 30, of the gas pressure cycler, 23, and to open the pressure and vent valve, 80, only during and throughout the engine compression, expansion, and exhaust strokes, so that no pressure rise is developed in the variable volume chamber, 30. The pressure and vent valve, 80, vents the variable volume chamber, 30, to the engine intake manifold, 9, when open, via passages, 81, 82. The form of this invention shown in FIG. 4, uses a pressure and vent valve, 80, instead of the selector valve, 48, as shown in the FIG. 2 form of this invention, and thus can be used on a single cylinder internal combination engine. If used on a multicylinder engine, this FIG. 4 form of the invention will require a separate gas pressure cycler, 23, for each engine cylinder.

7. The backsides, 83, 84, of the liquid piston, 66, and the gas piston, 70, respectively are vented to the engine intake manifold, 9, via the passage, 82. With this particular arrangement the ratio of net pressure on the fuel in the liquid fuel chamber, 37, to the net pressure in the variable volume chamber, 30, of the gas pressure cycler can be approximated with the following equation:

$$\frac{(Af)(pf - p0)}{(Aa)(pa - po)} = \left(\frac{la}{lf}\right)$$

Wherein:

(AF)=Area of the liquid piston, 66;

(Aa)=Area of the gas piston, 70;

(pf)=Pressure in the liquid fuel chamber, 37, when the pressure in the variable volume chamber, 30, is (pa);

The operation of this FIG. 4 example of this invention, when engine speed and torque are varied, can be described as follows:

8. As engine speed increases, the pivot, 71, is moved closer to the liquid position, 66, by action of the fuel flow controller 76, on the pivot drive means, 75, so that higher pressures are created in the liquid fuel chamber, 37, during each intake stroke. As a result the mass rate of fuel flow per intake stroke can be maintained essentially constant, relative to the mass rate of air flow per intake stroke, despite the shortened time interval available for fuel delivery into the engine intake manifold. Also as engine speed decreases the pivot, 71, is moved further away from the liquid piston, 66.

9. To increase engine torque the air flow control means, such as the throttle, 64, is opened, thus increasing intake air density and the mass rate of flow of air per intake stroke. As engine torque is thusly increased, the pivot, 71, is moved closer to the liquid piston, 66, by action of the fuel flow controller, 76, on the pivot drive means, 75, so that higher pressures are created in the liquid fuel chamber, 37, during each intake stroke. As a result the mass rate of flow of fuel per intake stroke can be increased and maintained essentially constant, relative to the increased mass rate of air flow per intake stroke. Also as engine torque decreases the pivot, 71 is moved further away from the liquid piston, 66.

10. In these ways the form of this invention shown in FIG. 4 and described hereinabove can operate to maintain an essentially constant mean value of the air fuel mixture created in the engine intake manifold over a wide range of variation of engine torque and speed and this is one preferred form of this invention.

11. Another preferred form of this invention uses an engine exhaust gas composition sensor, 85, as an additional feedback input to the fuel flow controller, 76, so that net emissions of undesirable exhaust pollutants can be minimized. With the FIG. 4 form of this invention the fuel flow controller, 76, can in this way adjust the pivot, 71, position, not only in response to engine speed and torque changes, but also to maintain the mean value of air fuel ratio within the desired minimum net emissions "window" of mixture ratios, by use of such an exhaust composition sensor feedback. Present day automobile engines use an oxygen sensor as the exhaust gas composition sensor but other composition sensors can be used.

12. The fuel flow control means,76, can be similar to such control means as are now in use on many present automobile engines except that the output of the controller is to be for use on the kind of pivot drive means, 75, used, instead of the usual time interval of duration of fuel injection widely used on present automobile engines.

VARIABLE FUEL ORIFICE AREA COMPENSATOR

Figure 5:
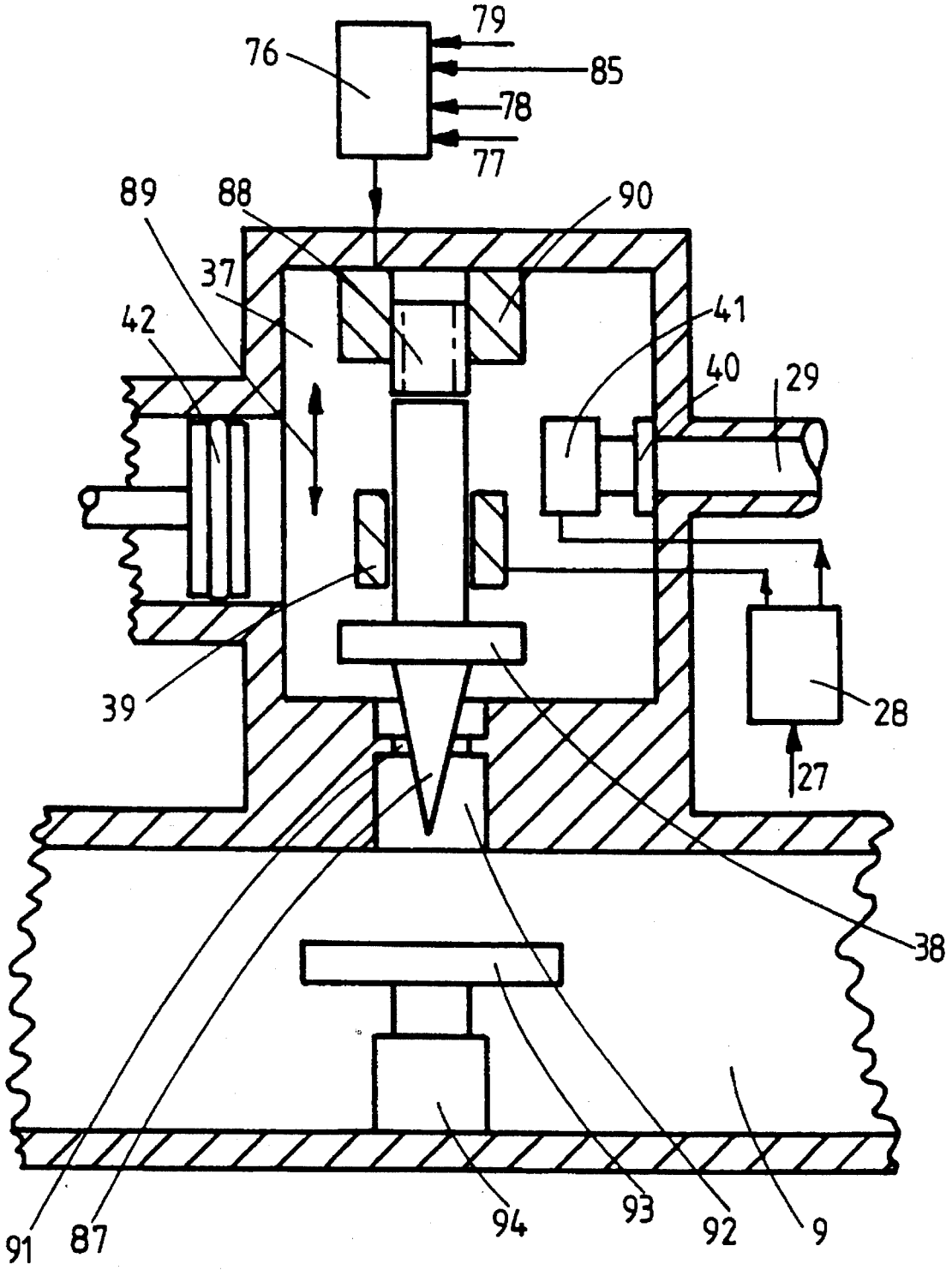
FIG. 5 is a cross-sectional view of the fuel injection nozzle of the invention.

A particular example modified form of fuel injector is shown in FIG. 5 and FIG. 1, which can be used instead of the modified pressure transmitter of FIG. 4 for internal combustion engines operated over a wide range of speed and torque output, and comprises:

1. The gas pressure cycler can be similar in construction and operation to that of FIG. 2 and is not shown in FIG. 5.

2. The modified fuel injector, 22, comprising liquid fuel chamber, 37, fuel supply valve, 40, with drive means, 41, nozzle valve, 38, with drive means, 39, liquid fuel pressurizer liquid piston, 42, is similar to that of FIG. 2 except as follows.

3. The injector nozzle, 92, comprises a fixed orifice, 86, within which a moveable tapered stem, 87, operates and this stem is fastened to the nozzle valve, 38. The tapered stem and nozzle valve are opened by the nozzle valve drive means, 39, against an adjustable stop, 88, during and throughout each engine intake stroke. P1 4. The adjustable stop, 88, is adjustable in the directions, 89, by the stop drive means, 90, which can be, for example, an electric stepping motor. When the stop, 88, is moved away from the nozzle, 92 the tapered stem, 87, opens a larger annular liquid fuel flow area, 91, when opened against the stop, 88, and the instantaneous mass flow rates of fuel are increased. When the stop, 88, is moved by the stop drive means, 90, toward the nozzle, 92, the tapered stem, 87, opens a smaller annular liquid fuel flow area, 91, when opened against the stop, 88, and the instantaneous mass flow rates of fuel are decreased. This adjustable stop and tapered nozzle valve stem with orifice scheme is an example of an area means for varying the area of the fuel injector nozzle through which liquid fuel flows.

5. The electronic fuel flow control means, 76, is responsive to; an intake air mass flow rate per intake stroke sensor, 77, an intake manifold pressure sensor, 78, an engine speed sensor, 79, and an engine exhaust gas composition sensor, 155, and operates upon the stop drive means, 90, to adjust the position of the stop, 88. The control means, 76, operates via the stop drive means, 90, so that liquid fuel flow area, 91, is increased when engine speed is increased, or when intake mass air flow rate per intake stroke is increased, or when intake manifold pressure decreases, and adjusts oppositely when these quantities change oppositely. Hence the operation of the fuel flow controller, 76, on this FIG. 5 form of the invention is essentially similar to the operation of the fuel flow controller of FIG. 4, except that in FIG. 5 the stop, 88, is adjusted instead of the pivot, 71.

6. For an essentially constant mean value of air fuel ratio over a range of engine speeds and torque outputs the relation between liquid fuel flow area, 91, can be approximated by the following equation for the FIG. 5 form of this invention when a constant mixture cam is used in the gas pressure cycler drive means:

$$\frac{(RPM)(WA)}{(Al)(\sqrt{po})} = (F5) = \left(\frac{A}{F}\right)_c \frac{(\sqrt{2g(df)})(\sqrt{J})(\sqrt{(CRC)^n} - 1)}{(3.1417)}$$

Wherein (Al) is the annular liquid fuel flow area, 91.

7. The fuel valve controller, 28, receives an input signal from the intake stroke sensor, 27, and operates to open and close the nozzle valve, 38, via its drive means, 39, and to open and close the fuel supply valve, 40, via its drive means, 41, so that the nozzle valve, 38, and connected tapered stem, 87, are opened against the stop, 88, only during and throughout the intake stroke, and so that the fuel supply valve, 40, is opened only when the nozzle valve, 38, is closed.

8. The operation of the FIG. 5 example of this invention, when engine speed and torque are varied, is similar to the operation of the FIG. 4 example of this invention, except that, fuel nozzle flow area is changed when engine speed or torque are changed for this FIG. 5 example, whereas liquid fuel pressure at the nozzle is changed by moving the pivot when engine speed or torque are changed for the FIG. 4 example.

LIQUID ATOMIZER

In many engine applications it will be preferred to add on a liquid fuel atomizer in the engine intake manifold in order to break up the liquid fuel in the engine intake manifold in order to break up the liquid fuel injected into the engine intake air mass so that rapid fuel evaporation will occur. Although the maximum pressure on the liquid fuel during injection may alone create adequate atomization, the necessarily low pressures on the liquid fuel at the beginning and ending of injection will not create good atomization. Various types of atomizer means can be used, such as the spinning disc, 93, and disc drive means, 94, shown in FIG. 5. The disc, 93, is placed in the engine intake manifold, 9, so that the liquid fuel leaving the nozzle, 92, is placed on the rapidly spinning disc, 93, which speeds up the liquid to the high leaving velocities needed for fine atomization. Various types of disc drive means, such as an electric motor, can be used. An air blast liquid fuel atomizer is shown in FIG. 1 comprising an air pump, 95, and air nozzle, 96. The pump brings a portion of the engine intake air mass up to a high pressure which causes this air portion to reach a high velocity as it leaves the air nozzle and strikes the liquid fuel, entering the intake manifold, 9, from the nozzle, 21.

USE OF STRATIFIER MEANS

It has been widely recognized for some time that substantial improvement in automobile miles per gallon of fuel can be achieved by use of small displacement, low speed, engines of consequently low engine friction power loss, combined with very high air intake supercharge to restore adequate torque output and vehicle performance. But knock and combustion violence will be greatly augmented when engine speed is low and high supercharge is being used. In consequence this scheme for improving automobile fuel efficiency is not now in use.

The use of stratified air fuel mixtures at gasoline engine intake to suppress the severity of compression ignition and knock is described in U.S. Pat. No. 4,425,892, entitled, "Further Improved Engine Intake Stratifier for Continuously Variable Stratified Mixtures," 17 Jan. 1984, and this material is incorporated herein by reference thereto.

The gasoline engine fuel injection systems of this invention can be readily modified to create stratified air fuel mixtures at engine intake in order to suppress the combustion violence of knock.

In the preferred forms of these mixture stratifier modifications, stratified air fuel mixtures are created only when needed as at low engine speeds with high supercharge and the low emissions, uniform, air fuel mixture is created at other engine operating conditions when knock is not taking place.

A stratified air fuel mixture can be created at engine intake whenever the ratio of instantaneous mass rate of air flow to instantaneous mass rate of fuel flow is varied about a mean value of air fuel ratio during each engine intake stroke. With the pivot stratifier means of this invention the pivot, of the pivoted lever pressure transmitter, is oscillated back and forth through a pivot cycle by an oscillating drive means about a mean pivot position. An alternative pressure stratifier means of this invention comprises a separate means for changing the volume of the variable volume chamber of the gas pressure cycler which cyclically adds and removes volume increments to and from the variable volume chamber during each engine intake stroke. In these ways both the pivot stratifier means and the alternative pressure stratifier means impose one or more cycles of pressure variation on the liquid fuel in the liquid fuel chamber and consequent cycles of variation of instantaneous mass rate of fuel flow, relative to the instantaneous mass rate of air flow, are created and thus a stratified air fuel mixture is generated during each intake stroke. These stratifier means can be turned on only when needed, as when combustion violence exceeds a selected amount as sensed by a combustion violence sensor, and this turning on and off of the stratifier means can be done by hand, or preferably automatically.

PIVOT STRATIFIER MEANS

Figure 6:
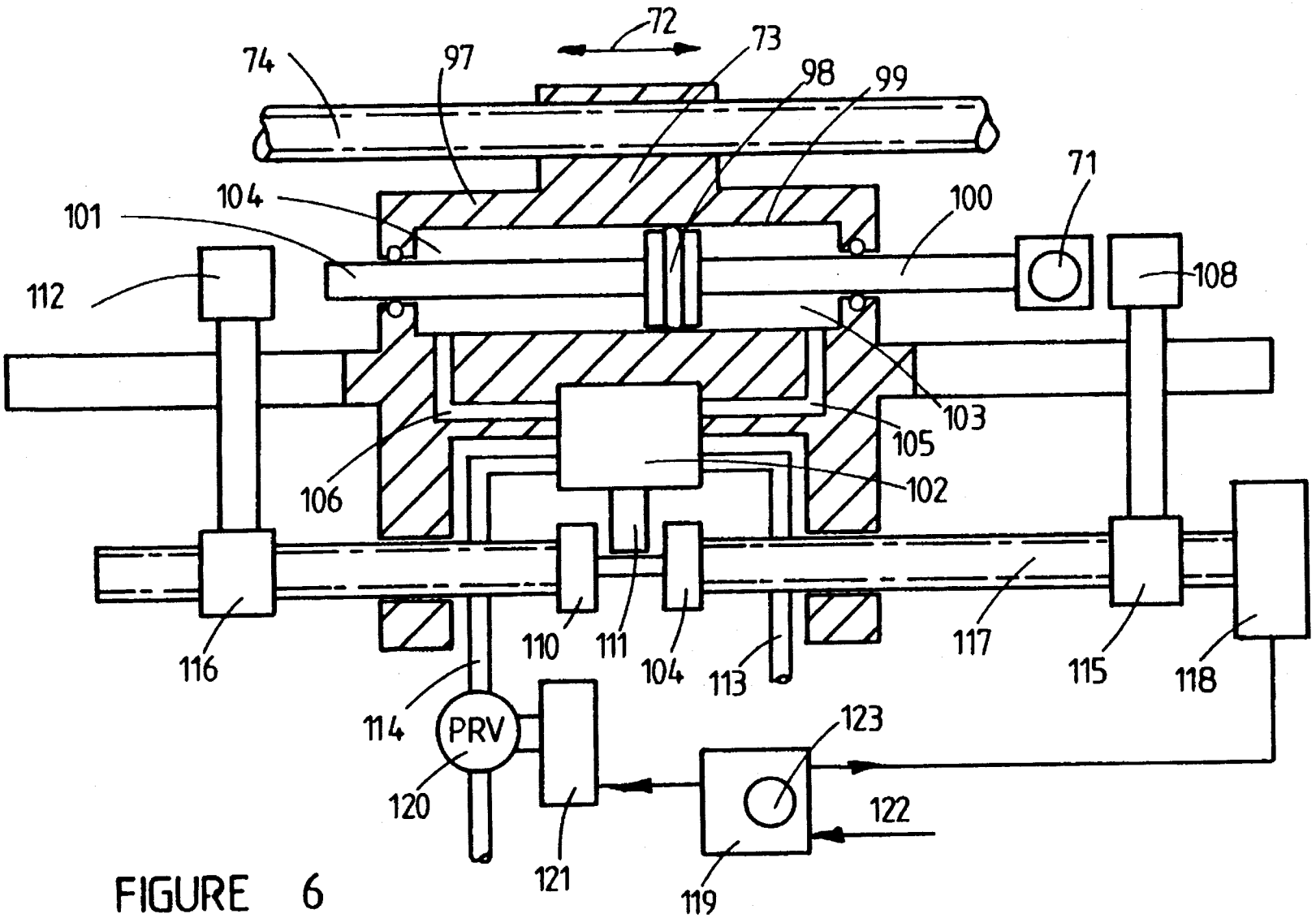
FIG. 6 is a cross-sectional view of the actuator of FIGS. 2 & 4.

An example pivot stratifier means, suitable for use with the fuel injection systems of this invention, is shown in FIG. 6, wherein the amplitude and the frequency of pivot oscillation can be varied, and comprises:

1. A pivot, 71, for the pivoted lever not shown in FIG. 6, and threaded pivot holder, 73, fitted to the adjustment screw, 74. The adjustment screw and pivot holder are adjusted in the direction, 72, by a pivot drive means and fuel flow control means in the same manner as described hereinabove for the pivoted lever pressure transmitter shown in FIG. 4.
2. A pneumatic oscillating drive means, 97, is interposed between the pivot, 71, and the pivot holder, 73, to drive the pivot, 71, back and forth through a pivot cycle, and comprises:
   a. A pivot drive piston, 98, operating sealably inside a cylinder, 99, with piston rods, 100, 101, extending sealably outside the cylinder, 99, and with the pivot, 71, secured to one piston rod, 100.
   b. A pneumatic cycle valve, 102, which admits high pressure air, or other gas, to either one end, 103, or the opposite end, 104, of the cylinder, 99, via passages, 105 and 106, respectively, from the high pressure air supply pipe, 114.
   c. An adjustable cycle valve trip mechanism, 107, is actuated by the piston rods, 100, 101, so that; when piston rod, 100, strikes the trip lever, 108, the cycle valve, 102, is tripped, via collars, 109, 110, and lever, 111, to admit high pressure air to the end, 103, of the cylinder, 99, and to vent the end, 104, of the cylinder, 99, via vent passage, 113, causing the pivot drive piston, 98, to move toward the opposite trip lever, 112. When piston rod, 101, subsequently strikes trip lever, 112, the cycle valve, 102, is tripped via lever, 111, to admit high pressure air to the end, 104, of the cylinder, 99, and to vent the end, 103, of the cylinder, 99, causing the pivot drive piston, 98, to move toward the trip lever, 108. In this way the pivot drive piston, 98, and the connected pivot, 71, are driven back and forth through a pivot cycle about a mean pivot position as set by the pivot drive means and fuel flow control means acting on the pivot holder, 73, via the adjustment screw, 74.
   d. The amplitude distance of the back and forth motion of the pivot, 71, can be adjusted by adjusting the separation distance between the two trip levers, 108, 112, as by use of right and left hand threads between the trip mechanism rotatable trip bar, 117, and the trip lever nuts, 115, 116, respectively so that rotation of the trip bar, 117, moves the trip levers, 108, 112, farther apart to increase the amplitude distance, or moves the trip levers, 108, 112, closer together to decrease the amplitude distance. This adjustment of the amplitude of pivot oscillation can be done by hand or preferably automatically via a reversible drive motor, 118, controlled by a control means, 119. By thusly reducing the amplitude of pivot oscillation to zero the back and forth pivot cycle, and also the consequent air fuel mixture stratification, ceases.
   e. The frequency of pivot oscillation about the mean pivot position, and hence the number of back and forth pivot cycles per engine intake stroke can be increased by increasing the pressure of the high pressure air supply and can be decreased by decreasing this pressure, as by action of a pressure regulating valve, 120. This adjustment of the pressure regulating valve, 120, can be done by hand via the driver, 121, or preferably automatically via the control means, 119.
   f. Alternatively adjustable vent restrictor valves can be used on the vent passage, 113, to adjust the frequency of pivot oscillation.

3. An example pneumatic oscillating drive means is shown in FIG. 6 but other types of oscillating drive means can also be used, such as electric motor drive, or hydraulic drive.

4. As combustion violence increases due to knock and compression ignition the peak rate of increase of pressure in the engine cylinder increases, and sensors, 122, can be used, as shown in FIG. 1, responsive to this peak rate of increase of cylinder pressure. The thusly sensed peak rate of pressure increase can be an input, 122, to a controller, 119, to adjust the stratifier amplitude and the stratifier frequency via drive means, 118, and 121, respectively. When sensed peak rate of pressure increase exceeds a selected value stratified fuel air mixtures can be created in the engine intake to suppress the combustion violence. As described in U.S. Pat. No. 4,425, 892, an increase of the range of air fuel ratios in the stratified air fuel mixture, as by increasing the amplitude of oscillation of the pivot, 71, will increase the compression ignition delay gradient and decrease the combustion violence. The selected preset value of sensed peak rate of increase of pressure above which the pivot, 71, is to be oscillated can be set by hand into the controller, 119, via the knob, 123. Further increase of sensed peak rate of pressure increase can act via the controller, 119, and drive means, 118, to increase the amplitude of pivot oscillation in order to suppress this increased combustion violence. Also as described in U.S. Pat. No. 4,425,892, an increase of the gradient of compression ignition delay, as by increasing the frequency of oscillation of the pivot, 71, will decrease the combustion violence. In these ways the combustion violence sensor, 122, and the stratifier amplitude and frequency control means, 119, can function to decrease combustion violence by increasing the amplitude of pivot oscillation, or by increasing the frequency of pivot oscillation, or both.

The effects of pivot oscillation on the range of air fuel ratios created in the engine intake manifold can be estimated from the following approximate equation when a constant mixture ratio cam drive is used on the gas pressure cycler:

$$\frac{(MaxA/F)}{(MinA/F)} = \frac{\sqrt{\left(lfo + \frac{lc}{2}\right)\left(lao + \frac{lc}{2}\right)}}{\sqrt{\left(lfo - \frac{lc}{2}\right)\left(lao - \frac{lc}{2}\right)}}$$

Wherein:

(Max A/F)=Maximum instantaneous mass ratio of air to fuel;

(Min A/F) - Minimum instantaneous mass ratio of air to fuel;

(lfo)=Mean distance from pivot, 71, to the end, 68, where the liquid piston, 66, connects to lever, 67;

(lao)=Mean distance from pivot, 71, to the end, 69, where the gas piston, 70, connects to lever, 67;

(lc)=Total amplitude of pivot oscillation about the mean position, lfo, lao;

PRESSURE STRATIFIER MEANS

Figure 7:
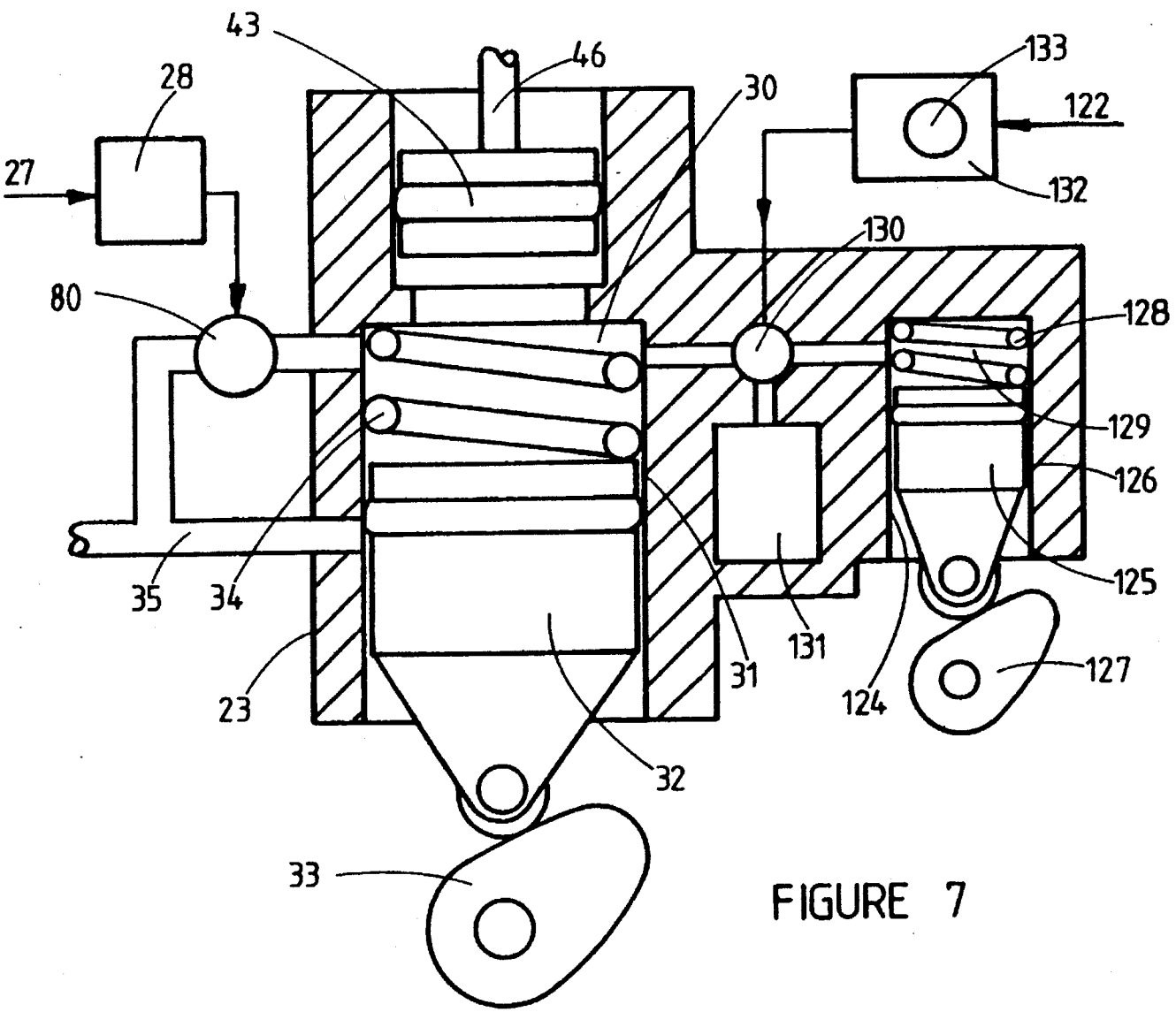
FIG. 7 is a cross-sectional view of a modified Pressure Cycler of FIGS. 2 & 4.

An example pressure stratifier means, suitable for use with the fuel injection systems of this invention, is shown in FIG. 7 and FIG. 1, wherein the gas pressure created in the gas pressure cycler, 23, is varied about a mean value, and comprises:

1. The gas pressure cycler, 23, comprising a variable volume chamber, 30, cylinder, 31, piston, 32, drive cam, 33, and return spring, 34, vent, 35, to engine intake manifold, gas piston, 43, creates a cycle of pressure increase followed by pressure decrease within the variable volume chamber during each engine intake stroke as already described hereinabove for the FIG. 2 form of the invention.

2. The fuel valve controller, 28, and intake stroke sensor, 27, operate on the pressure and vent valve, 80, so that a cycle of pressure increase and decrease occurs only during an engine intake stroke as described hereinabove for the FIG. 4 form of the invention.

3. The pressure stratifier means, 124, is a separate means for changing the volume of the variable volume chamber, 30, by adding volume increments thereto, and by removing these volume increments therefrom, and comprises:

a. A stratifier piston, 125, operates within a cylinder, 126, and is driven by a cam, 127, and return spring, 128, to change the volume of the stratifier chamber, 129.

b. A stratifier valve, 130, is an on-off means for connecting and disconnecting the stratifier chamber, 129, to the variable volume chamber, 30, of the gas pressure cycler, 23. The stratifier valve, 130, when not connecting to the stratifier chamber, 129, is connected instead to the fixed volume, 131, whose volume is preferably equal to the mean valve of the volume of the stratifier chamber, 129.

c. When the stratifier valve, 130, is connecting to the volume of the stratifier chamber, 129, this volume is incorporated with that of the variable volume chamber, 30. Thus when stratifier chamber volume is increasing due to downward motion of the stratifier piston, 125, volume increments are added to the variable volume chamber, 30. When stratifier chamber volume is decreasing due to upward motion of the stratifier piston, 126, volume increments are removed from the variable volume chamber, 30.

d. The piston drive cam, 127, is rotated by gearing from the engine crankshaft, 4, and preferably at an integral multiple of crankshaft speed with the integral being preferably four or more.

e. The pressure stratifier means of FIG. 7 thus superimposes a cycle of volume decrease and increase upon the variable volume chamber, 30, of the gas pressure cycler, 23. In this way cycles of pressure increase and decrease are superimposed on the pressure applied to the gas piston, 43, and, via the pressure transmitter, cycles of pressure increase and decrease are applied also to the liquid fuel in the liquid fuel chamber.

Further in this way cycles of increased and decreased fuel flow into the engine intake manifold are created which generate a stratified air fuel mixture at engine intake. The number of such cycles of decrease and increase of air fuel ratio is equal to half the integral multiple of cam, 127, rotating speed over crankshaft, 4, rotating speed.

f. The stratifier valve, 130, connects the variable volume, 30, to the stratifier chamber, 129, whenever sensed engine combustion violence exceeds a preset value, by operation of the controller, 132, responsive to a combustion violence sensor, 122. This preset value of sensed combustion violence an be set into the controller, 132, by hand setting of knob, 133.

g. The stratifier valve, 130, connects the variable volume, 30, to the fixed volume, 131, whenever sensed engine combustion violence is less than the preset value.

4. The example pressure stratifier shown in FIG. 7 and described hereinabove is a directly driven stratifier means. Alternative pressure stratifiers can be used instead. For example, an undriven piston acted on one face by the pressure in the variable volume, 30, of the gas pressure cycler, 23, and acted on the other face by a spring and a constant pressure, can create a single cycle of air fuel ratio stratification during each engine stroke.

Having thus described my invention what I claim is:

1. In a four stroke cycle internal combustion engine mechanism comprising: at least one piston, operative within a cylinder, and connected to a crankshaft via a connecting rod; each said piston and cylinder comprising: a variable volume chamber, between the crown of said piston and the head of said cylinder, whose volume varies when said piston is moved by said connecting rod within said cylinder by rotation of said crankshaft; an air intake valve and an exhaust valve gas flow connecting into said variable volume chamber and opened and closed by a valve drive means from said crankshaft; said valve drive means being timed relative to said piston so that a four stroke cycle is carried out with each two revolutions of said crankshaft; said four stroke cycle comprising in time order, an air intake stroke whenever said piston is moving to increase the volume of said variable volume chamber and said intake valve is opened and said exhaust valve is closed by said valve drive means, a compression stroke whenever said piston is moving to decrease the volume of said variable volume chamber and said intake and exhaust valve are closed by said valve drive means, an expansion stroke whenever said piston is moving to increase the volume of said variable volume chamber and said intake valve and said exhaust valve are closed by said valve drive means, a combustion process occurring during the ending of said compression stroke and the starting of said expansion stroke when fuel is supplied to said internal combustion engine mechanism, an exhaust stroke whenever said piston is moving to decrease the volume of said variable volume chamber and said exhaust valve is opened and said intake valve is closed by said valve drive means, and said four stroke cycle is repeated; an air supply manifold connection to said air intake valve; an exhaust gas manifold connection to said exhaust valve; a source of supply of engine liquid fuel at a pressure in excess of atmospheric; an ignition means for igniting compressed fuel air mixtures within said variable volume chamber so that a combustion process occurs during said compression and expansion strokes; an engine intake air density adjustment means for adjusting the density of the air in said air intake manifold;

an improvement comprising adding to said four stroke cycle internal combustion engine mechanism engine fuel injection systems wherein each said piston and cylinder is served by one such engine fuel injection system, each said engine fuel injection system comprising:

a gas pressure cycling means for cycling the pressure of a gas quantity so that during each cycle said gas pressure rises from a starting pressure to a peak pressure and said pressure rise is followed by a pressure decrease from said peak pressure to essentially said starting pressure; said gas pressure cycling means comprising, a variable volume chamber, containing said gas quantity, enclosed between a fixed container and a moveable element operating sealably within said fixed container, pressure cycler means for driving said moveable element so that said variable volume is decreased to increase the pressure of said gas quantity and is subsequently increased to decrease the pressure of said gas quantity and to thusly cycle the pressure of said gas quantity, first means for connecting said variable volume chamber to said engine air supply manifold only during the ending of said pressure decrease and the start of the next said pressure increase so that said starting pressure essentially equals the pressure in said engine air supply manifold;

fuel injector means for injecting liquid fuel into said engine air supply manifold during each said air intake stroke and comprising: a fuel injector nozzle, a liquid fuel chamber containing liquid fuel, a nozzle valve means for connecting and disconnecting said fuel injector nozzle to said liquid fuel chamber and comprising drive means for opening and closing said nozzle valve means, a fuel supply valve means for connecting and disconnecting said liquid fuel chamber to said engine fuel supply source and comprising drive means for opening closing said fuel supply valve means, a liquid fuel pressurizer means for applying pressure to said liquid fuel in said liquid fuel chamber;

said fuel injector nozzle of said fuel injector means connecting into said engine air supply manifold;

pressure transmitter means for transmitting pressure from said variable volume chamber of said gas pressure cycling means to said liquid fuel pressurizer means of said fuel injector means so that pressure increase in said variable volume chamber of said gas pressure cycling means is transmitted as pressure increase on said liquid fuel in said liquid fuel chamber, and so that pressure decrease in said variable volume chamber is transmitted as pressure decrease on said liquid fuel, and so that gas does not enter said liquid fuel chamber and so that liquid fuel does not enter said variable volume chamber of said gas pressure cycling means, said pressure transmitter means comprising: means for connecting and disconnecting said pressure transmitter to said variable volume chamber of said gas pressure cycling means so that, pressure increase and decrease in said variable volume chamber act upon said pressure transmitter only during and throughout each said air intake stroke, and so that the pressure acting upon said liquid fuel in said liquid fuel chamber via said pressure transmitter is less than said liquid fuel supply pressure during and throughout each said compression stroke, expansion stroke and exhaust stroke;

inter drive means for driving said pressure cycler drive means for driving said moveable element of said gas pressure cycling means from said crankshaft of said internal combustion engine mechanism so that, a pressure cycle takes place during each said air intake stroke, and so that the duration of said pressure cycle is essentially equal to the duration of said intake stroke;

intake stroke sensor means for sensing the start of said air intake stroke and the end of said air intake stroke of said internal combustion engine mechanism;

fuel valve control means for controlling the connecting and disconnecting of said fuel injector nozzle to said liquid fuel chamber and for controlling the connecting and disconnecting of said liquid fuel chamber to said engine fuel supply source, and responsive to said intake stroke sensor means, and operative upon said nozzle valve means drive means and said fuel supply valve drive means, so that said nozzle valve means connects said fuel injector nozzle to said liquid fuel chamber only from essentially the start to the end of each said air intake stroke, and so that said fuel supply valve means connects said liquid fuel chamber to said engine fuel supply source only when said nozzle valve means has disconnected said fuel injector nozzle from said liquid fuel chamber.

2. A four stroke cycle internal combustion engine mechanism as described in claim 1 wherein said pressure cycle means for driving said moveable element of said variable volume chamber of said gas pressure cycling means, and said inter drive means for driving said pressure cycler drive means from said crankshaft of said internal combustion engine mechanism, change the volume of said variable volume chamber relative to said crankshaft angular position so that, during each said intake stroke, the ratio of instantaneous mass rate of fuel flow into said air supply manifold to the instantaneous mass rate of air flow into said same air supply manifold remains essentially constant at a mean valve of air fuel ratio during that intake stroke, whenever said pressure cycle means for driving said moveable element of said variable volume chamber of said gas pressure cycling means is alone operative to change the pressure in said liquid fuel chamber of said fuel injector means for injecting liquid fuel.

3. A four stroke cycle internal combustion engine mechanism as described in claim 2 and further comprising stratifier means for creating stratified fuel in air mixtures during each air intake stroke so that the ratio of instantaneous mass rate of fuel flow into said air supply manifold to the instantaneous mass rate of air flow into said same air supply manifold varies about a mean valve during that intake stroke.

4. A four stroke cycle internal combustion engine mechanism as described in claim 3 and further comprising atomizer means for atomizing said liquid fuel when said liquid fuel is injected into said engine air supply manifold during each said air intake stroke.

5. A four stroke cycle internal combustion engine mechanism as described in claim 1 and further comprising atomizer means for atomizing said liquid fuel when said liquid fuel is injected into said engine air supply manifold during each said air intake stroke.

6. A four stroke cycle internal combustion engine mechanism as described in claim 2:

wherein said liquid fuel pressurizer means of said fuel injector means comprises a liquid piston acting sealably on one side upon said liquid fuel within said liquid fuel chamber, the opposite side of said liquid piston being connected to said engine air supply manifold;

wherein said pressure transmitter means comprises: a gas piston acted on one side sealably by said gas quantity within said variable volume chamber of said gas pressure cycling means; the opposite side of said gas piston being connected to said engine air supply manifold;

wherein said pressure transmitter means further comprises pivoted lever means for transmitting force from said gas piston to said liquid piston of said liquid fuel pressurizer and comprising a pivot, so that; whenever the gas pressure acting on the variable volume chamber side of said gas piston changes, the liquid pressure of said liquid fuel within said liquid fuel chamber of said fuel injector means changes in the same direction; and so that; the ratio of said net gas pressure to said net liquid pressure remains essentially constant when said pivot of said pivoted lever means is fixed relative to said gas piston and said liquid piston.

7. A four stroke cycle internal combustion engine mechanism as described in claim 6:

wherein said pivot of said pivoted lever means comprises pivot adjustment means for adjusting the position of said pivot relative to said gas piston and said liquid piston so that the ratio of said net gas pressure of the gas quantity within said variable volume of said gas pressure cycling means to said net liquid pressure of said liquid fuel within said liquid fuel chamber of said fuel injector means can be changed, said pivot adjustment means comprising pivot drive means for moving the pivot;

air flow control means for controlling the rate of air flow, per intake stroke into said engine air supply manifold;

air intake pressure sensor means for sensing the air pressure within said engine air supply manifold;

air flow sensor means for sensing the air mass flow rate into said engine air supply manifold per intake stroke;

fuel flow control means for controlling the mass rate of fuel flow per intake stroke into said engine air supply manifold via said fuel injector means, and responsive to said air flow sensor means and said air intake pressure sensor means, and operative upon said pivot drive means of said pivot adjustment means, so that the ratio of said mass rate of fuel flow per intake stroke into said engine air supply manifold to the mass rate of air flow per intake stroke into said engine air supply manifold remains essentially constant.

8. A four stroke cycle internal combustion engine mechanism as described in claim 7 and further comprising:

pivot stratifier means for creating stratified fuel in air mixtures during each air intake stroke, and comprising oscillating drive means for moving said pivot of said pivoted lever means through a back and forth pivot cycle an amplitude distance relative to said gas piston and said liquid piston, about a mean pivot position when said nozzle valve means of said fuel injector means is open and connecting said fuel injector nozzle to said liquid fuel chamber, at least one such back and forth pivot cycle being carried out during each said air intake stroke.

9. In a four stroke cycle internal combustion engine mechanism as described in claim 8:

wherein said pivot stratifier means further comprises frequency adjustment means for adjusting the number of said back and forth pivot cycles carried out during each said air intake stroke.

10. A four stroke cycle internal combustion engine mechanism as described in claim 9 and further comprising:

engine combustion violence sensor means for sensing the peak rate of increase of pressure during said combustion process within said variable volume chamber of said internal combustion engine mechanism;

stratifier frequency control means for controlling the number of said back and forth pivot cycles during each said air intake stroke, and responsive to said engine combustion violence sensor means, and operative upon said frequency adjustment means of said pivot stratifier means, so that said frequency of back and forth motion of said pivot is increased when said sensed peak rate of increase of pressure during said combustion process increases above a frequency preset value, said stratifier frequency control means comprising presetting means for hand setting said frequency preset valve of sensed peak rate of increase of pressure.

11. A four stroke cycle internal combustion engine mechanism as described in claim 8 wherein said pivot stratifier means further comprises amplitude adjustment means for adjusting the amplitude distance of said back and forth pivot cycle.

12. A four stroke cycle internal combustion engine mechanism as described in claim 11 and further comprising:

engine combustion violence sensor means for sensing the peak rate of increase of pressure during said combustion process within said variable volume chamber of said internal combustion engine mechanism;

stratifier amplitude control means for controlling the amplitude distance of said back and forth pivot cycle of said pivot stratifier means, and responsive to said engine combustion violence sensor means, and operative upon said amplitude adjustment means of said pivot stratifier means, so that said amplitude distance is increased when said sensed peak rate of increase of pressure during said combustion process increases above an amplitude preset value, said stratifier amplitude control means comprising presetting means for hand setting said amplitude preset valve of sensed peak rate of increase of pressure.

13. A four stroke cycle internal combustion engine mechanism as described in claim 12 and further comprising:

atomizer means for atomizing said liquid fuel when said liquid fuel is injected into said engine air supply manifold during each said air intake stroke.

14. A four stroke cycle internal combustion engine mechanism as described in claim 7 and further comprising:

exhaust gas sensor means for sensing the composition of the engine exhaust gas in said exhaust gas manifold;

wherein said fuel flow control means for controlling the mass rate of fuel flow is further responsive to said exhaust gas sensor means so that the mass rate of fuel flow per intake stroke is controlled so that the composition of the engine exhaust gas remains essentially constant.

15. A four stroke cycle internal combustion engine mechanism as described in claim 8 and further comprising:

atomizer means for atomizing said liquid fuel when said liquid fuel is injected into said engine air supply manifold during each said air intake stroke.

16. A four stroke cycle internal combustion engine mechanism as described in claim 7 and further comprising:

pressure stratifier means for creating stratified fuel in air mixtures during each air intake stroke and comprising separate means for changing the volume of said variable volume chamber of said gas pressure cycling means, said separate means for changing the volume being separate from said moving element of said gas pressure cycling means, so that volume increments are cyclically added to and removed from the volume of said variable volume chamber during each intake stroke, at least one such cycle of volume addition and removal occurring during each intake stroke, and so that an integral number of said cycles of volume addition and removal occur during each intake stroke.

17. A four stroke cycle internal combustion engine mechanism as described in claim 16 wherein said pressure stratifier means further comprises on-off means for connecting and disconnecting said separate means for changing the volume of said variable volume chamber from said variable volume chamber of said gas pressure cycling means;

and further comprising:

engine combustion violence sensor means for sensing the peak rate of increase of pressure during said combustion process within said variable volume chamber of said internal combustion engine mechanism;

on-off control means for controlling the connecting and disconnecting of said separate means for changing the volume of said variable volume chamber, and responsive to said engine combustion violence sensor means, and operative upon said on-off means for connecting and disconnecting said separate means for changing the volume, so that, said separate means for changing the volume is connected to said variable volume chamber of said gas pressure cycling means only when said sensed peak rate of increase of pressure during said combustion process exceeds a pressure stratifier preset value, said on-off control means comprising presetting means for hand setting said pressure stratifier preset value of sensed peak rate of increase of pressure.

18. A four stroke cycle internal combustion engine mechanism as described in claim 16 and further comprising:

atomizer means for atomizing said liquid fuel when said liquid fuel is injected into said engine air supply manifold during each said air intake stroke.

19. A four stroke cycle internal combustion engine mechanism as described in claim 17 and further comprising:

atomizer means for atomizing said liquid fuel when said liquid fuel is injected into said engine air supply manifold during each said air intake stroke.

20. A four stroke cycle internal combustion engine mechanism as described in claim 2 wherein said fuel injector nozzle of said fuel injector means further comprises area means for varying the area of said fuel injector nozzle through which liquid fuel flows.

21. A four stroke cycle internal combustion engine mechanism as described in claim 20 and further comprising:

air flow control means for controlling the rate of air flow, per intake stroke into said engine air supply manifold;

air intake pressure sensor means for sensing the air pressure within said engine air supply manifold;

air flow sensor means for sensing the air mass flow rate into said engine air supply manifold per intake stroke;

fuel flow control means for controlling the mass rate of fuel flow per intake stroke into said engine air supply manifold via said fuel injector means, and responsive to said air flow sensor means and said air intake pressure sensor means, and operative upon said area means for varying the area of said fuel injector nozzle, so that the ratio of said mass rate of fuel flow per intake stroke into said engine air supply manifold to the mass rate of air flow per intake stroke into said engine air supply manifold remains essentially constant.

22. A four stroke cycle internal combustion engine mechanism as described in claim 21 and further comprising exhaust gas sensor means for sensing the composition of the engine exhaust gas in said exhaust gas manifold;

wherein air fuel flow control means for controlling the mass rate of fuel flow is further responsive to said exhaust gas sensor means so that said mass rate of fuel flow per intake stroke is controlled so that the composition of the engine exhaust gas remains essentially constant.

* * * * *

UNITED STATES PATENT AND TRADEMARK OFFICE

CERTIFICATE OF CORRECTION

PATENT NO. : 5,456,232

DATED : October 10, 1995

INVENTOR(S) : Joseph C. Firey

It is certified that error appears in the above-indentified patent and that said Letters Patent is hereby corrected as shown below:

Column 6, line 66: Change, "valve", to, --value--;

Column 11, line 40: Change, "VCLP", to, --VCLO--;

Column 11, line 41: Change, "VCLP", to, --VCLO--;

Column 11, line 35: Add, --ra=ral-(gcm)(ral-rao)--;

Column 12, line 46: Add, --0--, between X and =;

Column 15, line 17: Change, "79", to, --71-;

Column 18, line 9: Change, "155", to, --85--;

UNITED STATES PATENT AND TRADEMARK OFFICE

CERTIFICATE OF CORRECTION

PATENT NO. : 5,456,232
DATED : October 10, 1995
INVENTOR(S) : Joseph C. Firey

It is certified that error appears in the above-indentified patent and that said Letters Patent is hereby corrected as shown below:

Column 24, line 23: Add, --and--, between opening and closing;

Column 25, line 25: Change, "valve", to, --value--;

Column 25, line 39: Change, "valve", to, --value--;

Column 29, line 1: Change, "air", to, --said--;

Signed and Sealed this

Second Day of April, 1996

Bruce Lehman

*Attest:*

BRUCE LEHMAN

*Attesting Officer*

*Commissioner of Patents and Trademarks*